US006661337B2

(12) United States Patent
Ha et al.

(10) Patent No.: US 6,661,337 B2
(45) Date of Patent: Dec. 9, 2003

(54) PROCESSOR BASED STROBE WITH FEEDBACK

(75) Inventors: Simon Ha, Aurora, IL (US); Daniel C. Scheffler, Winfield, IL (US); Daniel J. Austin, Streamwood, IL (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/040,968

(22) Filed: Jan. 7, 2002

(65) Prior Publication Data

US 2002/0125840 A1 Sep. 12, 2002

Related U.S. Application Data

(63) Continuation-in-part of application No. 09/767,897, filed on Jan. 23, 2001.
(60) Provisional application No. 60/293,083, filed on May 23, 2001.

(51) Int. Cl.[7] ..... G08B 25/00; H05B 37/00
(52) U.S. Cl. ..... 340/293; 315/120
(58) Field of Search ..... 315/120, 121, 315/129, 131, 133; 340/288, 293, 331, 333

(56) References Cited

U.S. PATENT DOCUMENTS

| | | | | | |
|---|---|---|---|---|---|
| 5,341,069 | A | * | 8/1994 | Kosich et al. | 315/241 S |
| 5,400,009 | A | * | 3/1995 | Kosich et al. | 340/331 |
| 5,523,654 | A | * | 6/1996 | Sikora et al. | 315/241 R |
| 5,598,139 | A | | 1/1997 | Karim et al. | |
| 5,608,375 | A | * | 3/1997 | Kosich | 340/293 |
| 5,673,030 | A | * | 9/1997 | Kosich | 340/635 |
| 5,751,210 | A | | 5/1998 | Kosich | |
| 5,850,178 | A | | 12/1998 | Ha et al. | |
| 5,982,275 | A | | 11/1999 | Kosich | |
| 6,049,446 | A | * | 4/2000 | Ha et al. | 361/58 |
| 6,194,994 | B1 | | 2/2001 | Curran et al. | |
| 6,311,021 | B1 | * | 10/2001 | Kosich | 396/164 |

* cited by examiner

*Primary Examiner*—Don Wong
*Assistant Examiner*—Minh D A
(74) *Attorney, Agent, or Firm*—Welsh & Katz, Ltd.

(57) ABSTRACT

Strobe control circuitry combines several approaches to limit in-rush current. One circuit limits initial circuit response to an applied voltage that has been switched from an inactive to an active state. Other circuitry switches from a high input impedance state to a low input impedance state a predetermined period of time after the applied voltage has switched to an active state.

21 Claims, 23 Drawing Sheets

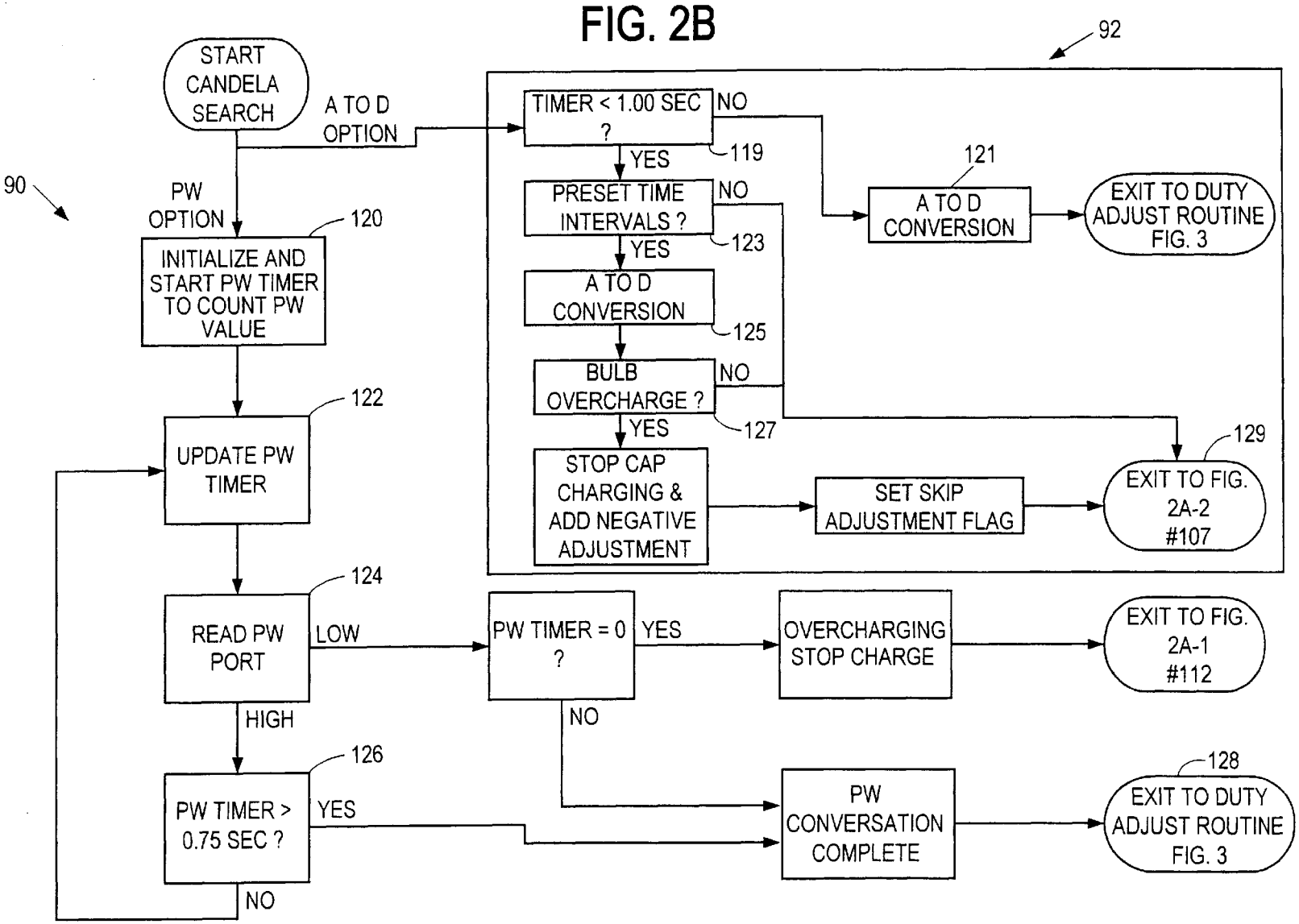
FIG. 2B
START CANDELA SEARCH
A TO D OPTION
PW OPTION
INITIALIZE AND START PW TIMER TO COUNT PW VALUE
120
UPDATE PW TIMER
122
READ PW PORT
124
LOW
HIGH
PW TIMER > 0.75 SEC ?
126
YES
NO
PW TIMER = 0 ?
YES
NO
OVERCHARGING STOP CHARGE
EXIT TO FIG. 2A-1 #112
PW CONVERSATION COMPLETE
128
EXIT TO DUTY ADJUST ROUTINE FIG. 3
TIMER < 1.00 SEC ?
119
NO
YES
PRESET TIME INTERVALS ?
123
NO
YES
A TO D CONVERSION
125
BULB OVERCHARGE ?
127
NO
YES
STOP CAP CHARGING & ADD NEGATIVE ADJUSTMENT
SET SKIP ADJUSTMENT FLAG
A TO D CONVERSION
121
EXIT TO DUTY ADJUST ROUTINE FIG. 3
EXIT TO FIG. 2A-2 #107
129
92
90

1 SECOND FLASH
1 SECOND FLASH
1 SECOND FLASH
NO ERROR
VOLTAGE ERROR
VOLTAGE ERROR
60
TARGET BULB VOLTAGE
A TO D CONVERSION
A TO D CONVERSION
A TO D CONVERSION
DC VOLTS

T4 = T3
CORRECTION #2
T2
T3 = T2+CORRECTION #2
CORRECTION #1
T1
T2 = T1+CORRECTION #1
T1(US)

PROCESSOR BASED STROBE WITH FEEDBACK

This application is a continuation-in-part of U.S. patent application Ser. No. 09/767,897, filed Jan. 23, 2001, entitled "Processor Controlled Strobe" and incorporated herein by reference; and also claims the benefit of the filing date of May 23, 2001 of Provisional Application Ser. No. 60/293,083, and entitled Processor Based Strobe With Feedback.

FIELD OF THE INVENTION

The invention pertains to strobe lights driven by programmed processors. More particularly, the invention pertains to such strobes which respond to variable input voltages and wherein in-rush currents are limited.

BACKGROUND OF THE INVENTION

Circuits for driving strobe lights of a type usable in alarm systems are known. Some known circuits charge a capacitor using constant frequency, variable current signals. Others have incorporated a coil in combination with frequency varying circuits. One known system has been disclosed in U.S. Pat. No. 5,850,178, issued Dec. 15, 1998, entitled "Synch Module With Pulse Width Modulation" and assigned to the assignee hereof.

Known circuits have been designed to be driven from a single nominal voltage such as 12 volts or 24 volts. In addition, known circuits have been designed to drive a gas filled tube to produce a single, nominal candela output.

There is a need for more flexible strobe drive circuitry. Preferably a single drive circuit could accommodate a range of nominal input voltages. In addition, it would be desirable to be able to select from a range of desirable candela output levels without regard to available input voltage.

Finally, it would be preferable if in-rush currents could be limited under various conditions. One known system is disclosed in Ha et al U.S. Pat. No. 6,049,446 assigned to the assignee hereof and entitled, "Alarm Systems and Devices Incorporating Current Limiting Circuit", incorporated herein by reference.

Preferably, the above noted features could be implemented so as to promote manufacturability, and to limit operating in-rush currents. It would also be preferable if such flexibility did not appreciably increase unit cost.

SUMMARY OF THE INVENTION

A strobe drive circuit combines circuits to accept variable input drive voltages with circuitry responsive to selectable candela output levels. In one aspect, the circuitry monitors the time to charge a capacitor to a selected, predetermined voltage. In another aspect, the actual capacitor voltage is monitored. A gas filled tube can be triggered at the appropriate voltage. Other types of visible output devices could also be used.

The charging duty cycle can be varied to respond to various input voltages as well as differing predetermined flash voltages. The duty cycle of the drive current is continually corrected with each flash.

In one embodiment, surge currents are substantially eliminated by starting with a lower duty cycle and increasing same over time, with each flash. With this configuration, power supply fold back or over-current conditions can be substantially eliminated.

In another aspect, the charging current duty cycle can be incremented one or more times from an initial value while charging the capacitor. Simultaneously, the capacitor's voltage can be monitored. Depending on the results, for example the value of the flash voltage of the present flash cycle, the current charging current duty cycle can be altered for the next flash cycle.

In another aspect, a current smoothing circuit limits initial turn-on current for a predetermined interval after power is applied. For example, turn-on current can be limited for an interval in a range of 300–700 ms with 500 ms being a preferred interval. This is especially advantageous where numerous strobes are connected to a common power source.

Where synchronization pulses are applied to the drive circuit, for example from an external source which might be a fire alarm system, capacitor charging can be interrupted or terminated when such pulses are present. This will minimize charge depletion from the capacitor(s).

Where applied energy is in the form of full wave rectified AC, surge currents can be minimized after each flash by commencing charging (after each flash) by waiting till the rectified AC voltage drops to a predetermined low value. For example, charging can be commenced once the applied AC drops to about zero volts.

A programmed processor can be incorporated into the control circuitry. Information can be stored relative to a plurality of available candela outputs. When a specific output has been selected, corresponding pre-stored information is used by the processor to charge the capacitor to the respective output voltage.

In another embodiment, the capacitor voltage can be measured, digitized in an A/D converter, and compared to a plurality of pre-stored values. In response to the comparison step, charging current duty cycle can be altered.

The control process also responds to input voltage variations. With a lower input voltage, the charge current duty cycle will increase to provide the necessary capacitor voltage. With a larger input voltage, the duty cycle will decrease.

A control method includes the steps of establishing a plurality of target pulse widths based on respective candela outputs; selecting a candela output level; charging an energy source until either a selected voltage is reached or until a predetermined time interval has ended; keeping track of the actual charging time interval; comparing the actual charging time interval to the target pulse width associated with the selected candela output; where the actual time interval is less than the target pulse width, decreasing the charging parameter a selected amount and where the actual time interval is greater than the target pulse width, increasing the charging parameter.

Where the selected voltage is repetitively reached before the predetermined time interval has ended, the charging parameter can be repetitively reduced. This reduction can be via a decreasing amount. Where the predetermined time interval repetitively ends before the selected voltage has been reached, the charging parameter can be repetitively increased.

In another embodiment, capacitor voltage can be digitized and compared to a candela specific target value. Depending on the results of this comparison, charging duty cycle can be altered.

In either embodiment, the closed loop control system responds to variations in input voltage. Charging duty cycle is adjusted in response thereto to maintain a selected candela output level. Variations in the input voltage in a range on the order of 4:1 can be accommodated.

Desired candela output level can be manually set at a unit. Alternately, it can be downloaded to a unit, as a programmable parameter, from a remote source.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 2A-1 is an overall flow diagram of a method illustrating one form of operation of the system of FIG. 1;

FIG. 2A-2 is an over-all flow diagram of a method illustrating an alternate form of operating the system of FIG. 1;

FIG. 2B is a flow diagram illustrating additional details of the methods of FIGS. 2A-1 and 2A-2;

FIG. 4-1 is a flow diagram illustrating a candela adjustment process in accordance with the method of FIG. 2A-1;

FIG. 4-2 is a flow diagram illustrating a candela adjustment process in accordance with the method of FIG. 2A-2;

FIGS. 5-1, 5-2, and 5-3 are timing diagrams which taken together illustrate candela target searching for raising a bulb voltage to a target voltage in accordance with the method of FIG. 2A-1;

FIGS. 6-1, 6-2, 6-3 are timing diagrams which taken together illustrate candela target searching for lowering a bulb voltage to a target voltage in accordance with the method of FIG. 2A-1;

FIGS. 7-1, 7-2, are timing diagrams which taken together illustrate candela target searching for raising a bulb voltage to a target voltage in accordance with the method of FIG. 2A-2;

FIGS. 8-1, 8-2 are timing diagrams which taken together illustrate candela target searching for lowering a bulb voltage to a target voltage in accordance with the method of FIG. 2A-2.

FIGS. 12-1, -2, -3, -4 are graphs illustrating capacitor charging in response to an applied DC signal with synchronizing pulses;

FIGS. 13-1, -2, -3, -4 illustrate capacitor charging in the presence of two relatively close together control pulses;

FIGS. 14-1, -2, -3, -4 are graphs of incrementally increasing capacitor charging in response to full wave rectified AC applied power in the presence of two relatively close together control signals;

FIGS. 15-1, -2, -3, -4 are graphs of charging processes in response to relatively close together drop-out control pulses;

FIGS. 16-1, -2, -3 illustrate operation of a regulator without a smoothing capacitor in the presence of applied energy;

FIGS. 16-4, -5, -6 illustrate operation of a regulator with a start-up smoothing capacitor;

DETAILED DESCRIPTION OF THE PREFERRED EMBODIMENTS

Figure 1:
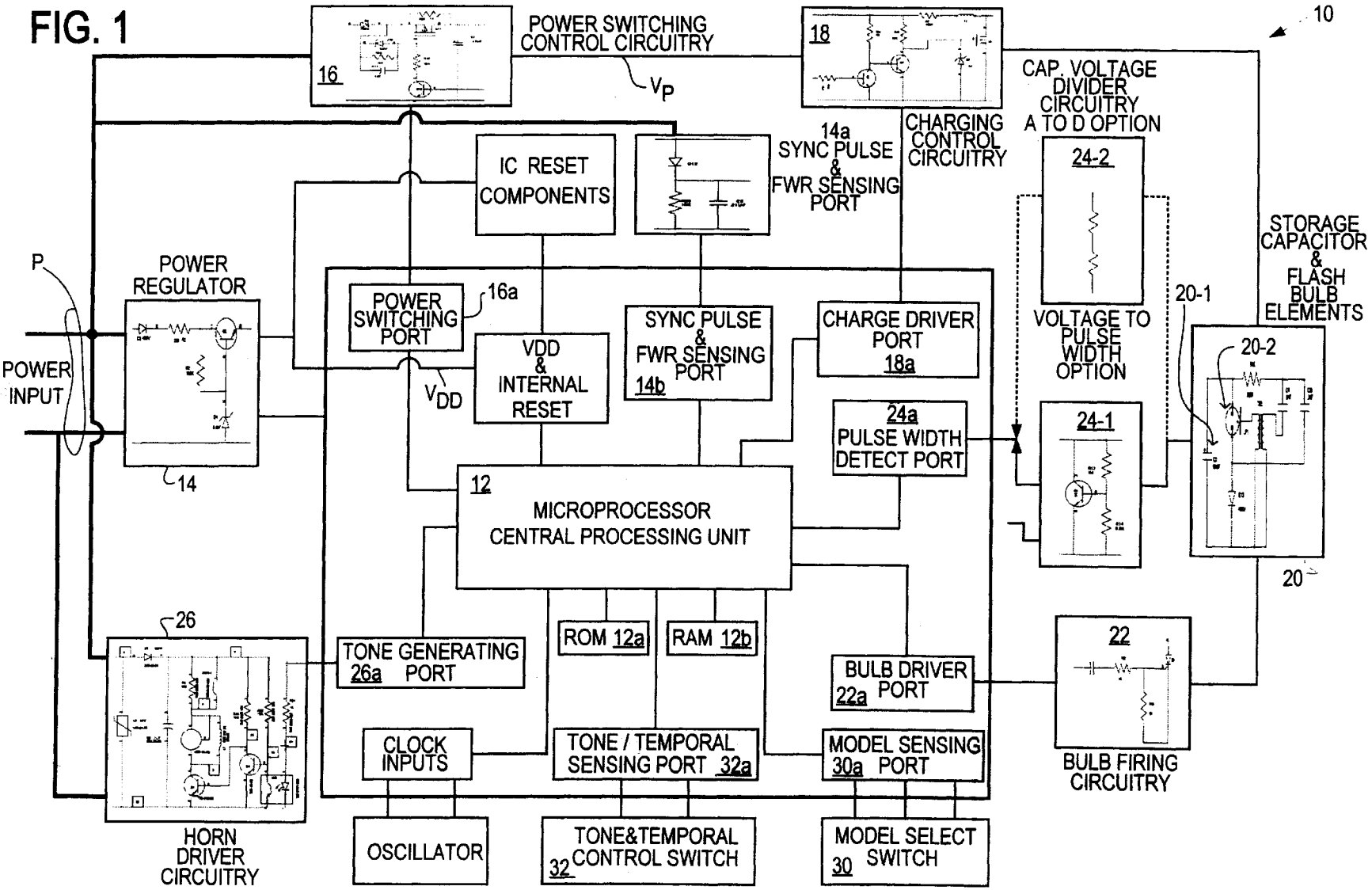
FIG. 1 is a block diagram of a system, having two feedback options, in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a block diagram of two embodiments of a system 10, a multi-candela visual output device. The system 10 includes a control element, for example a programmable processor, 12.

The processor 12 is coupled to a read-only or programmable read-only memory 12*a* and read/write memory 12*b*. Memory units 12*a*, 12*b* can store executable instructions for carrying out methods discussed subsequently as well as parameters and results of on-going calculations.

A power regulator 14 is coupled to power input lines P. Exemplary circuitry, as would be understood by those of skill in the art, is illustrated in various of the circuit blocks, such as circuit block 14. The operation of regulator 14 is discussed subsequently with respect to FIGS. 16-4, -5, -6.

Lines P provide electrical energy, synchronization pulses and additional control pulses. Lines P can be coupled to a fire alarm control unit or other control devices.

The voltage on the lines P can vary, for example, between 6–40 volts DC. The principles of the present invention can be used with other ranges of input voltages and can be used with half wave or full wave rectified AC input voltages in a range of 6–33 volts RMS without departing from the spirit and scope of the present invention. Synchronization and/or control pulses present in applied DC or rectified AC can be in the form of down-going transitions to, for example, zero volts. Other forms of embedded synchronization or control pulses come within the spirit and scope of the present invention.

As discussed below, system 10 automatically adjusts to various input voltages. By way of example, it can be powered without any changes from 12 volts DC or 12 volts FWR, 24 volts DC or 24 volts FWR.

Power control circuitry 16 is coupled to lines P and to charging control circuitry 18. Operation of power control circuitry 16 is discussed subsequently with respect to FIGS. 17 and 18A–C.

Processor 12 is coupled to circuitry 16 via port 16*a* and to charging control circuitry 18 via port 18*a*. Processor 12 is coupled to regulator 14 via sync pulse and sensing circuits 14*a* and sensing port 14*b*.

The charging control circuit 18 is coupled to circuits 20 which include capacitor 20-1 and flash bulb or tube 20-2 and provides electrical energy to charge the capacitor therein using, for example either a variable or a constant frequency, variable duty cycle signal. Bulb firing circuitry 22 is coupled via driver port 22*a* to processor 12. Where the capacitor in element 20 has been charged to a predetermined value, based on selected candela output, the processor 12 can trigger, or flash the bulb via port 22*a*.

In one embodiment, voltage to pulse width feedback circuitry 24-1 provides feedback, in the form of a down-going voltage, to processor 12 which indicates that the voltage across the capacitor, element 20-1, has reached a predetermined value. This is a value which is independent of selected candela output. As discussed subsequently, this feedback signal, could be coupled to processor 12 via port 24*a*, can be used to adjust a charging current duty cycle via control circuitry 18.

In a second embodiment, an analog-to-digital converter, integral to processor 12 or as a separate circuit, can convert flash bulb or tube voltage across capacitor 20-1, reduced by divider circuit 24-2, to a digital value. This digital, capacitor voltage value can be compared to a candela related target value, selected by switch 30, and the results thereof used to adjust a charge current duty cycle.

Horn driver circuit 26, via port 26*a* is coupled to processor 12 and enables the processor 12 to drive an audible output device in accordance with a preselected tonal pattern. The pattern can be synchronized by synchronizing signals received at port 14*b*.

Model select register or switch 30, via port 30*a* is coupled to processor 12. Switch register 30 can be set, locally or remotely to specify one of several available candela outputs, such as 15, 30 or others of interest. Processor 12 can, in response to a signal(s) from register or switch 30 specifying a selected candela output, and, electrical energy of various voltages applied to regulator 14 and power control 16, charge capacitor 20-1 to a voltage which when tube 20-2 is flashed or fired produces the selected candela output.

Temporal control switch 32 can be set to select an audible tonal output pattern. Switch 32 is coupled to processor 12 via port 32*a*.

Figures 1, 1A:
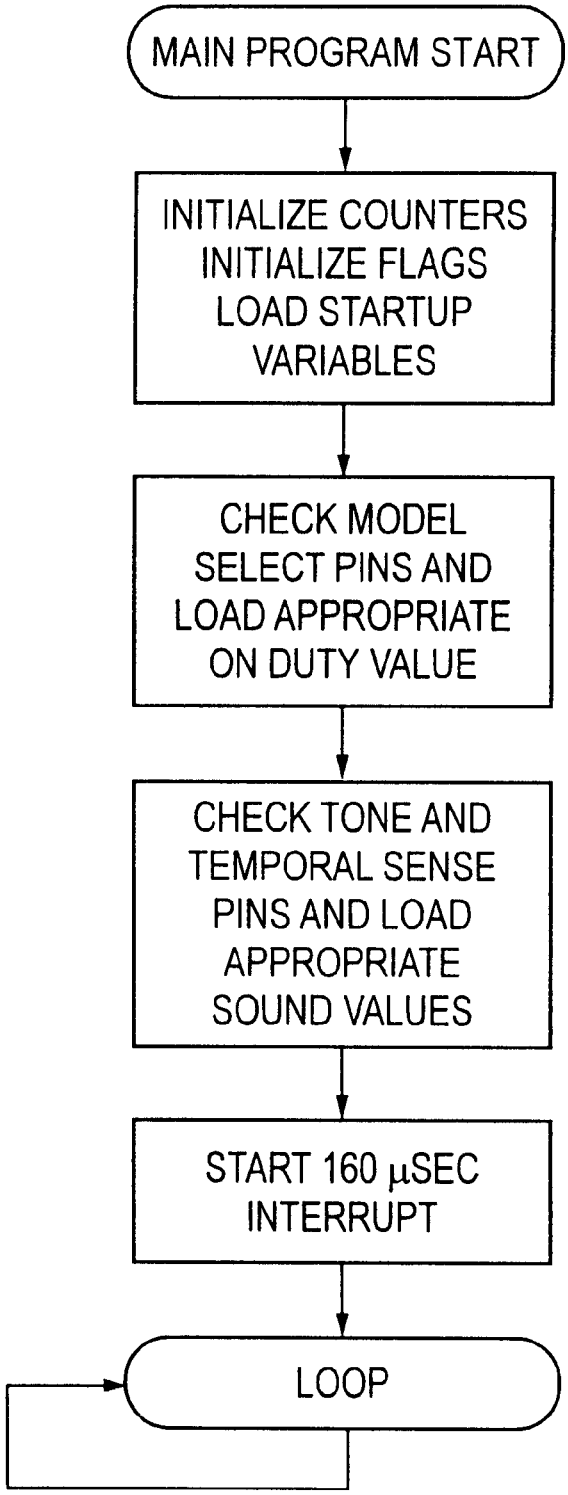
FIG. 1A is a flow diagram which illustrates over-all processing in a system as in FIG. 1.

FIG. 1A illustrates in over-all form processing carried out by processor 12. Interrupt processing steps 302, 304 phases 1, 2 are carried out by processor 12 where pulse width feedback, circuits 24-1 and 24*a* have been implemented. Details of phase 2 processing, step 304, are discussed subsequently with respect to FIGS. 2A-1, 2B and FIG. 4-1.

Interrupt processing steps 312, 314 phases 1, 2 are carried out by processor 12 where analog-to-digital feedback, circuits 24-2, 24*a* have been implemented. Details of phase 2 processing, step 314 are discussed subsequently with respect to FIGS. 2A-2, 2B and FIG. 4-2.

Figures 1, 1A, 2:
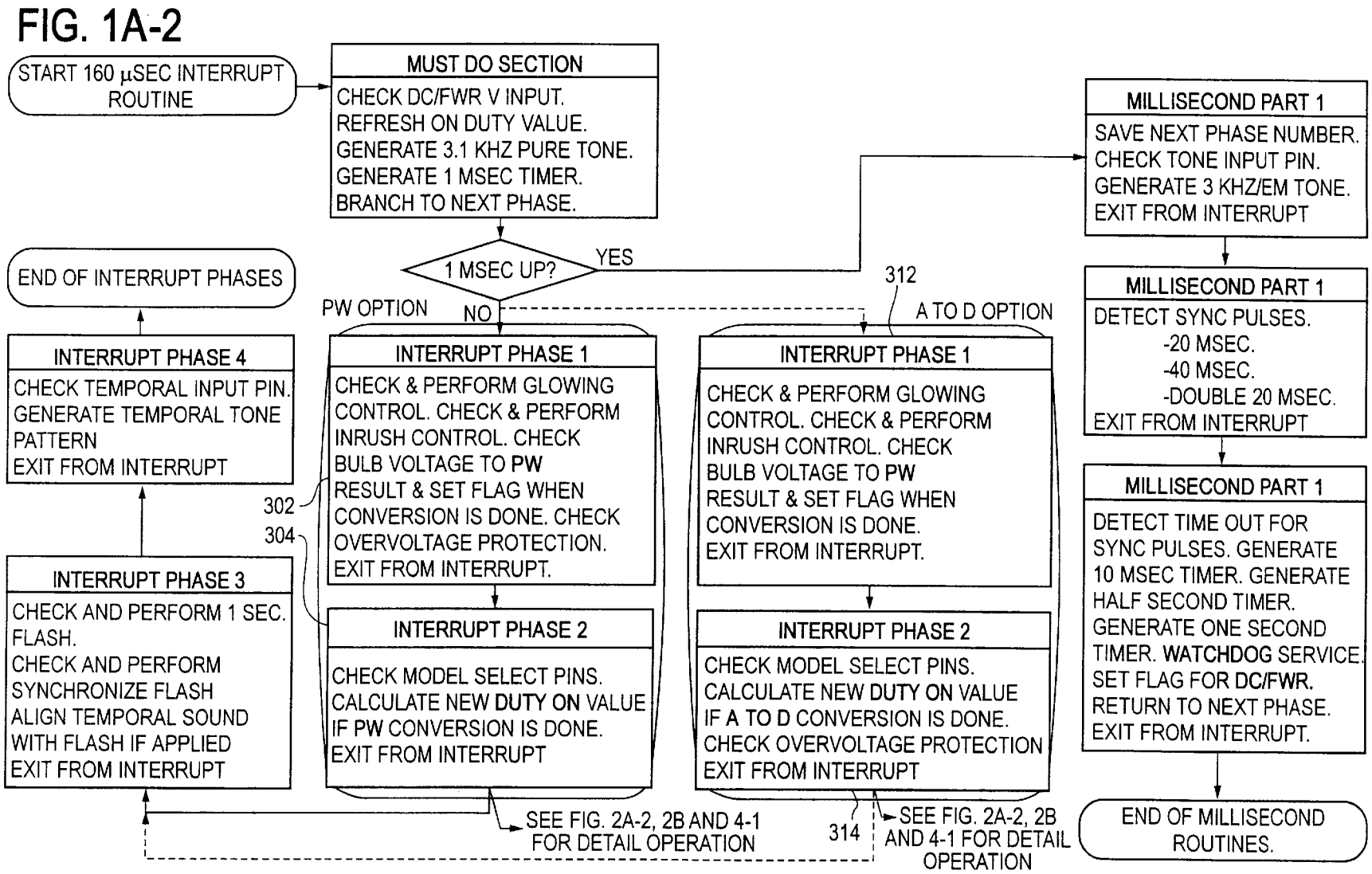
Figures 1, 2, 2A:
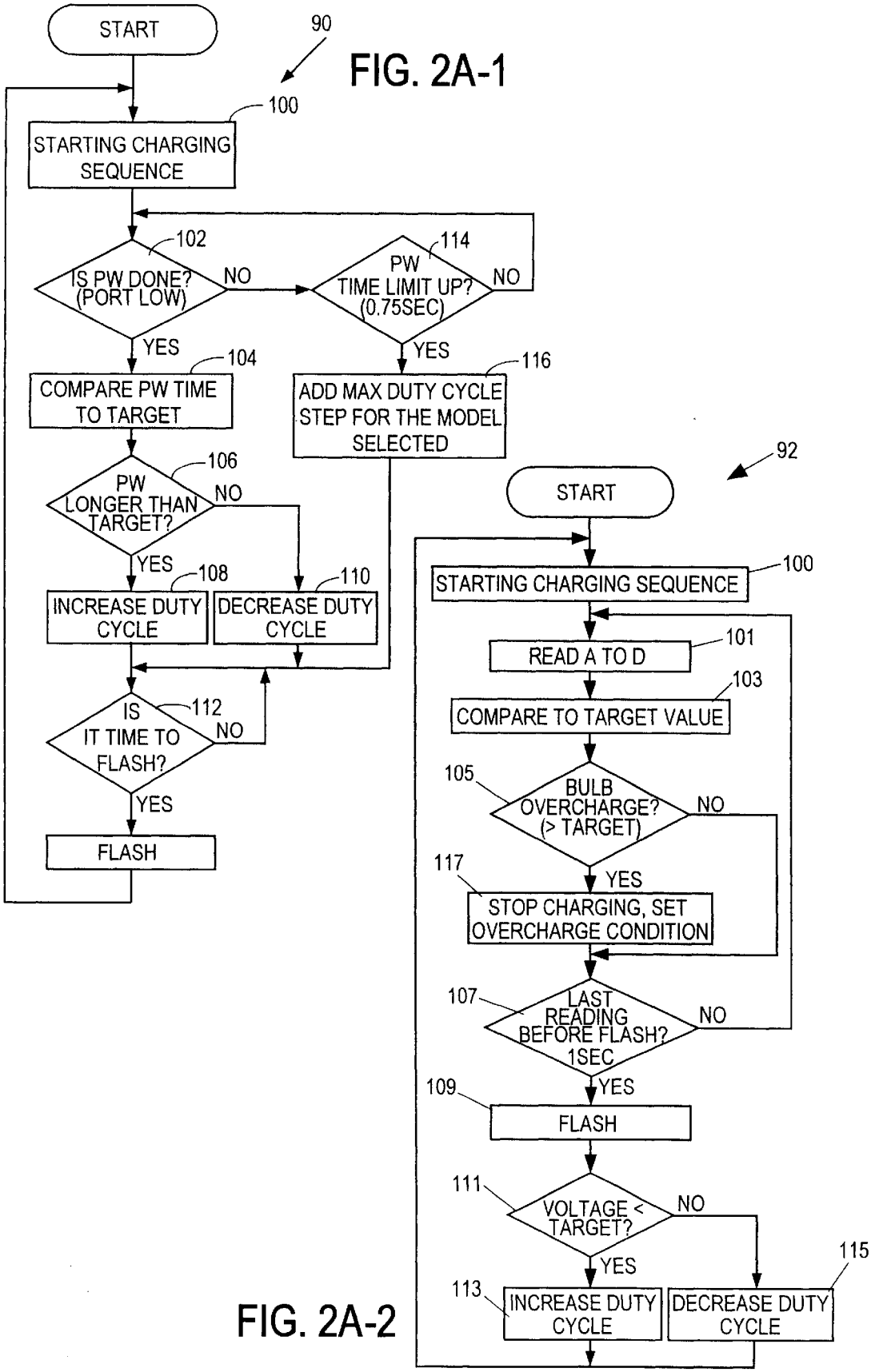

FIGS. 2A-1 and 2A-2 illustrate two different control processes 90, 92 in accordance with the present invention. Those of skill will understand that the processes are periodic. An exemplary one second cycle is disclosed and discussed, see FIG. 10. It will be understood that other periods or cyclic intervals could be used without departing from the spirit and scope of the present invention.

FIG. 2A-1 illustrates steps of a method 90 of operating system 10 using feedback circuit 24-1. In an initial step 100 a capacitor charging sequence is started. In step 102, circuitry 24-1, via port 24*a* is checked. If low, the capacitor voltage has reached a predetermined value (the same for all candela output). If low, in step 104, the feedback signal time to transition from high to low is compared to a target value.

In a step 106 if the feedback transition time interval exceeds the target parameter, the capacitor is not being charged quickly enough and the duty cycle for charging the capacitor is increased in a step 108. If the feedback transition time interval is less than the target parameter, the capacitor is being charged to quickly and the duty cycle for charging the capacitor is decreased in a step 110. Subsequently, in step 112 the tube, element 20-2, is flashed.

If the feedback signal from circuit 24-1 is high in step 102, in step 114, feedback signal time to transition is compared to a maximum interval of 0.75 second. If at the limit, in a step 116, duty cycle is increased a maximum amount based on selected candela output.

In summary, with respect to process 90:

1. When a specific candela is selected, the executable instructions assign a target pulse width value (discussed in more detail subsequently, FIGS. 5-2 and 6-2). As each flash occurs, the conversion for bulb voltage to pulse width begins. After the conversion is complete, the result is used to compare to the target pulse width value.
2. If the result pulse width value is more than the target value, the charging on duty value will increase. This increase in the duty cycle causes the charging to increase and as a result, the pulse width decreases. The amount of duty cycle increase depends on how far the actual pulse width is from the target. The further away the target pulse width is, the more the increase will be applied to charging.
3. The opposite of step 2, above, occurs if the result pulse width value is smaller than the target value. The duty cycle will now decrease to slow down the rate of the charging.

The charging adjustment continues at each flash until the final target value is reached and dynamically adjusts the duty value in order to keep the pulse width equal to the target value. The process of reaching the target pulse width allows the system to track any input voltage in the specified range for that candela, discussed in more detail subsequently, see FIG. 9.

One exemplary flash interval is on the order of one second. Other flash intervals can also be used without departing from the spirit and scope of the present invention.

FIG. 2A-2 illustrates an alternate process 92 which uses divider circuitry 24-2 and an associated analog-to-digital converter. A charging sequence is initiated in the step 100.

The feedback value, via circuits 24-2 is read and converted, step 101. The digitized value is compared to a pre-stored target value, step 103.

If the feedback voltage has not exceeded the target value, step 105, a comparison is made in step 107 to a flash interval, for example a one second interval, and if appropriate the tube is flashed in step 109.

If the feedback voltage is less than the target value, step 111, the duty cycle is increased, step 113. If not, it is decreased, step 115. Bulb voltage is compared to a maximum in a step 117. If too large, the capacitor can be discharged.

Figure 10:
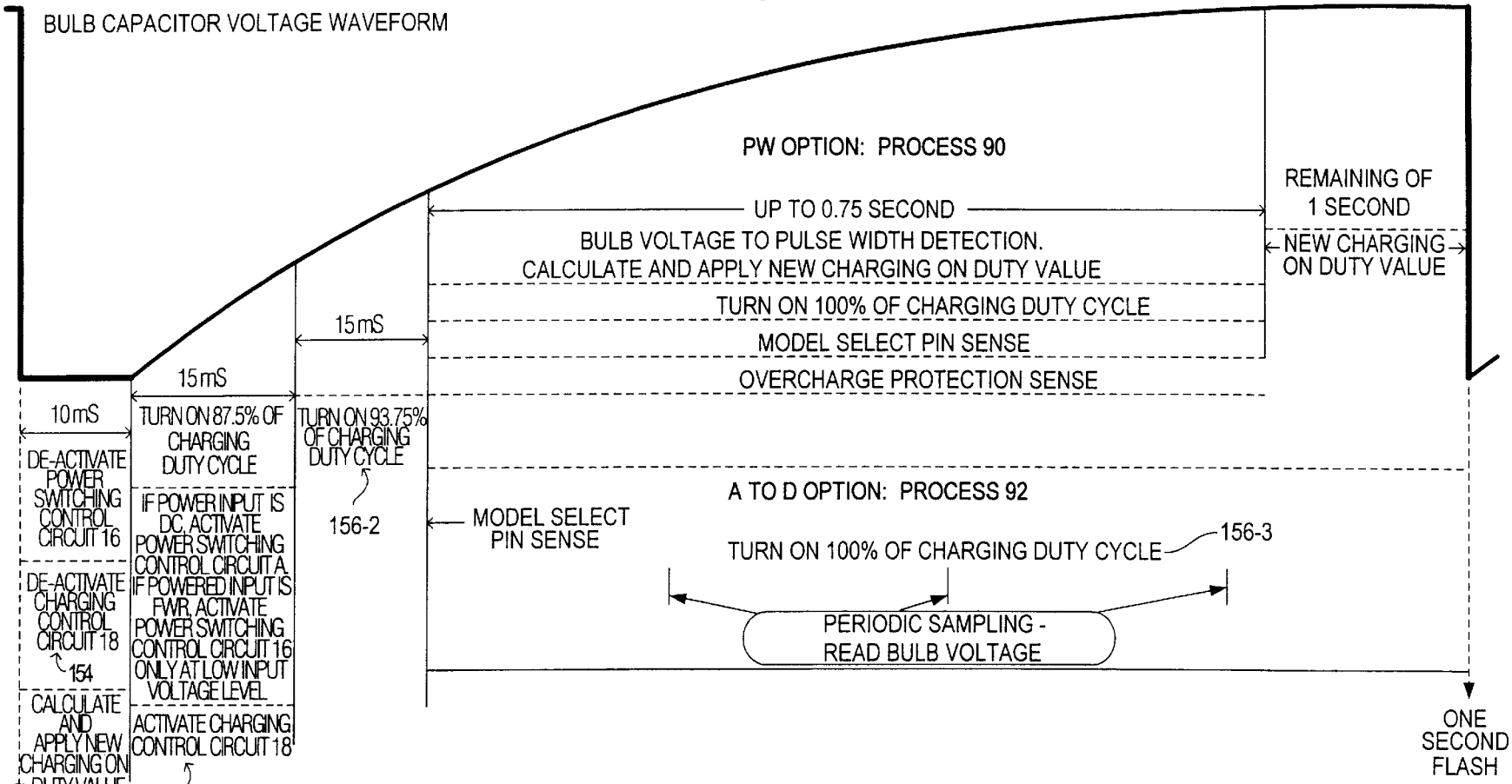
FIG. 10 illustrates additional aspects of the methods of FIGS. 2A-1, -2.

FIG. 2B illustrates additional aspects of the steps of the method 90 of FIG. 2A-1 and of alternate process 92, FIG. 2A-2. FIG. 10 illustrates additional details of processes 90, 92 on a per-cycle basis.

Figure 3:
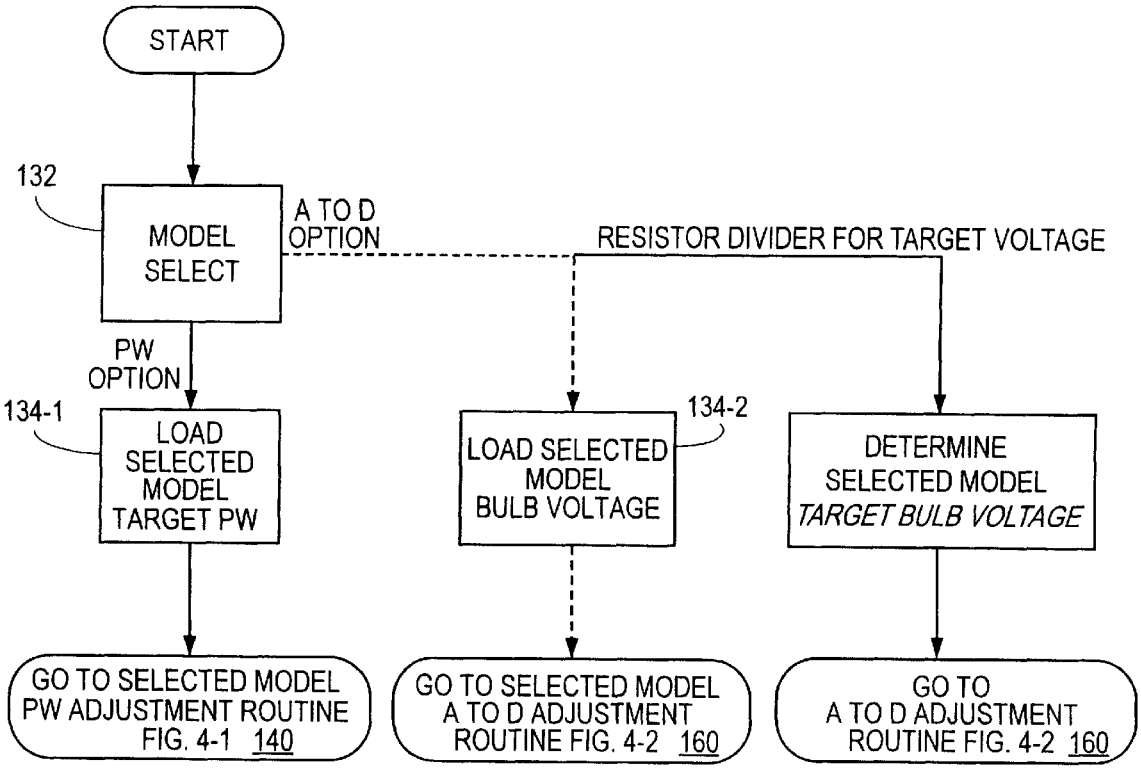
FIG. 3 is a flow diagram illustrating selection of an adjustment routine.

With respect to process 90, in step 120 the timer is initialized. In a step 122 it is incremented. In a step 124 the feedback signal, from element 24 is evaluated. If high, the target voltage has not net been reached and the contents of the timer are compared in a step 126 to 0.75 seconds. If less than or equal, the process returns to step 122. If not, the process exits, step 128, and duty cycle adjust routine is initiated, see FIG. 3. Where the pulse width port indicates in step 124 that the capacitor is exhibiting a predetermined voltage, if the timer contents are non-zero the duty adjust routine of FIG. 3 is initiated step 128.

With respect to process 92, if the time equals or exceeds 0.9 seconds, step 119, an analog-to-digital conversion takes place, step 121. The duty cycle adjust routine, FIG. 3, is then entered.

In steps 123, 125, an analog-to-digital conversion takes place multiple times in each charging cycle at preset time intervals. In the absence of a detected over-voltage condition, step 127, the sample time of the latest voltage value is compared to the latest possible sample time for each cycle, step 107, to determine if a flash cycle should be initiated.

Figures 1, 2, 7:
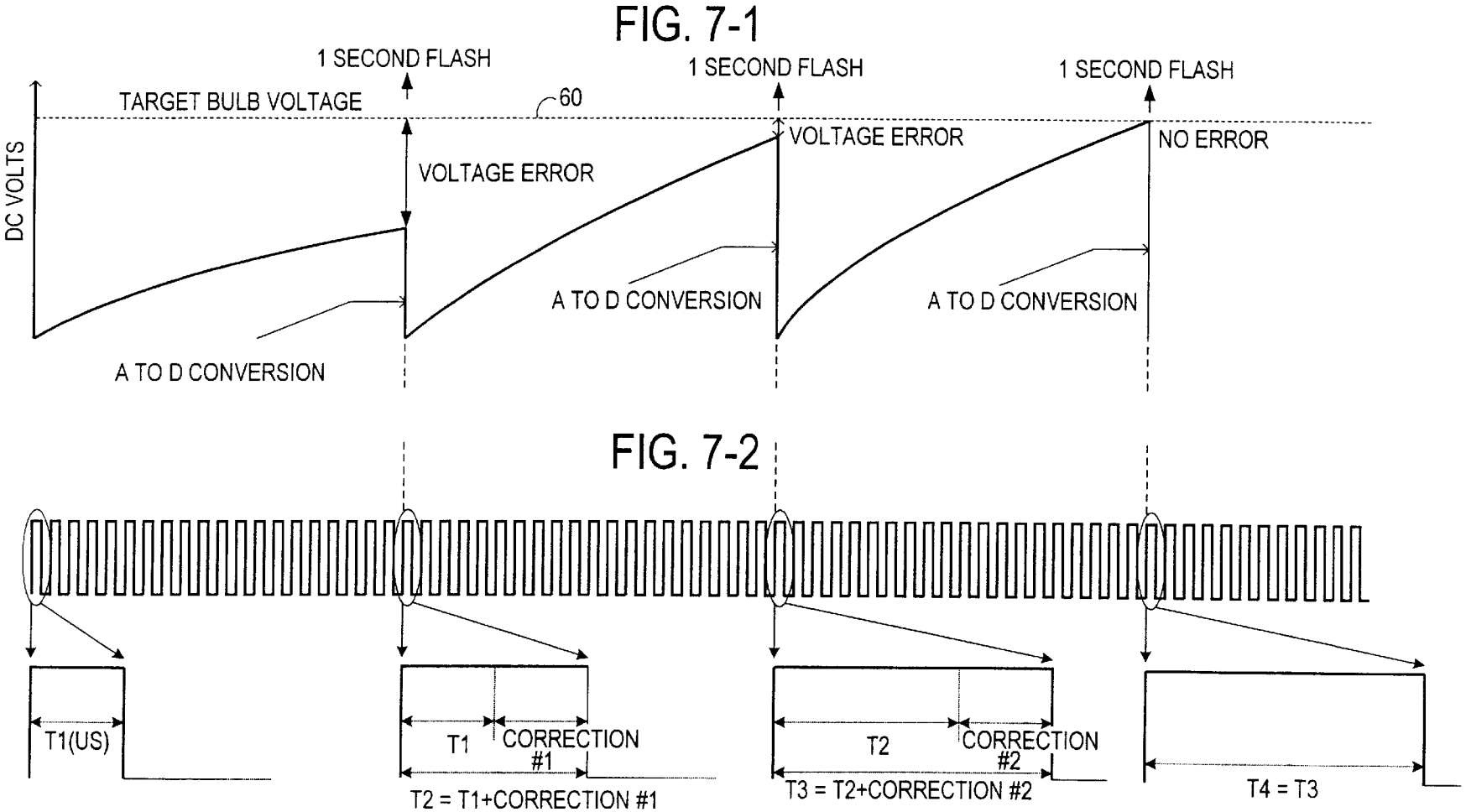

In summary, with respect to process 92:

1. When a specific candela is selected, the executable instructions assign a target bulb voltage (see #60, FIGS. 7-1 and 8-1). As each flash occurs, the conversion for bulb voltage to pulse width begins, after the conversion is complete, the result is used to compare to the target pulse width value.
2. If the result bulb voltage value is more than the target value, the charging on duty value will increase. This increase in the duty cycle causes the charging to increase and as a result, the bulb voltage increases. The amount of duty cycle increase depends on how far the actual bulb voltage is from the target. The further away the target bulb voltage is, the more the increase will be applied to charging.
3. The opposite of step 2 above, occurs if the result bulb voltage value is smaller than the target value. The duty cycle will now decrease to slow down the rate of the charging.

The charging adjustment continues at each flash until the final target value is reached and dynamically adjusts the duty value in order to keep the bulb voltage equal to the target value. The process of reaching the target bulb voltage allows the system to track any input voltage in the specified range for that candela.

The capacitor voltage is continuously monitored with the A to D to prevent overcharging. In the event that the capacitor voltage is greater than the target value, the charging will be stopped until the voltage drops below the target. The duty cycle will be adjusted at the beginning of the next charge cycle.

FIG. 3 illustrates evaluating the selected candela output specified, for example by setting switch 30, in step 132. The respective target pulse width is retrieved from storage units 12*a,b* step 134-1 or the respective target bulb voltage is retrieved from storage, step 134-2. Alternately, in step 134-3 a selected target bulb voltage is sensed off of a variable voltage source, for example, a resistor voltage divider circuit. The respective adjustment routine is then entered in one of FIGS. 4-1 and 4-2.

Figures 1, 4:
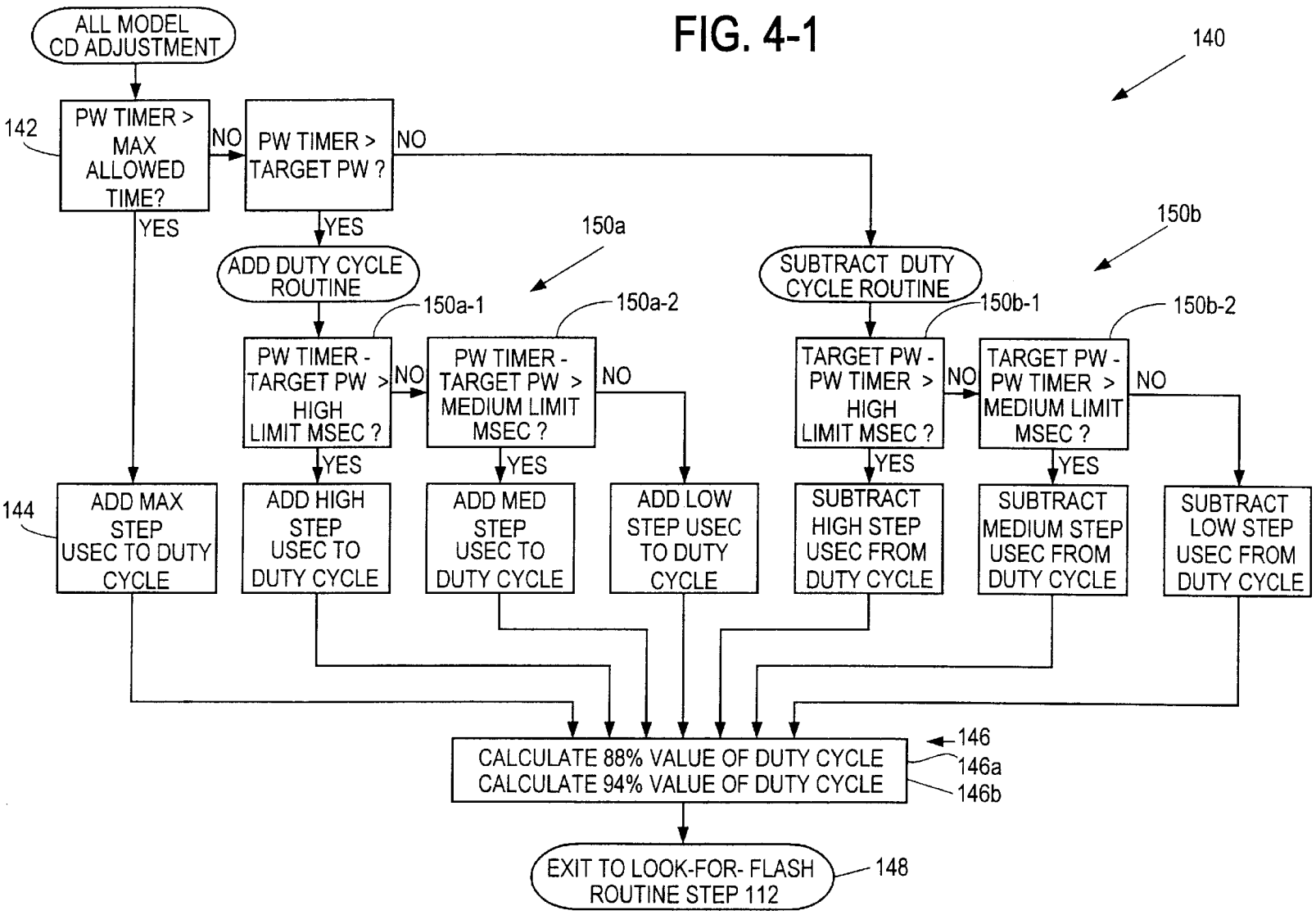
Figures 2, 4:
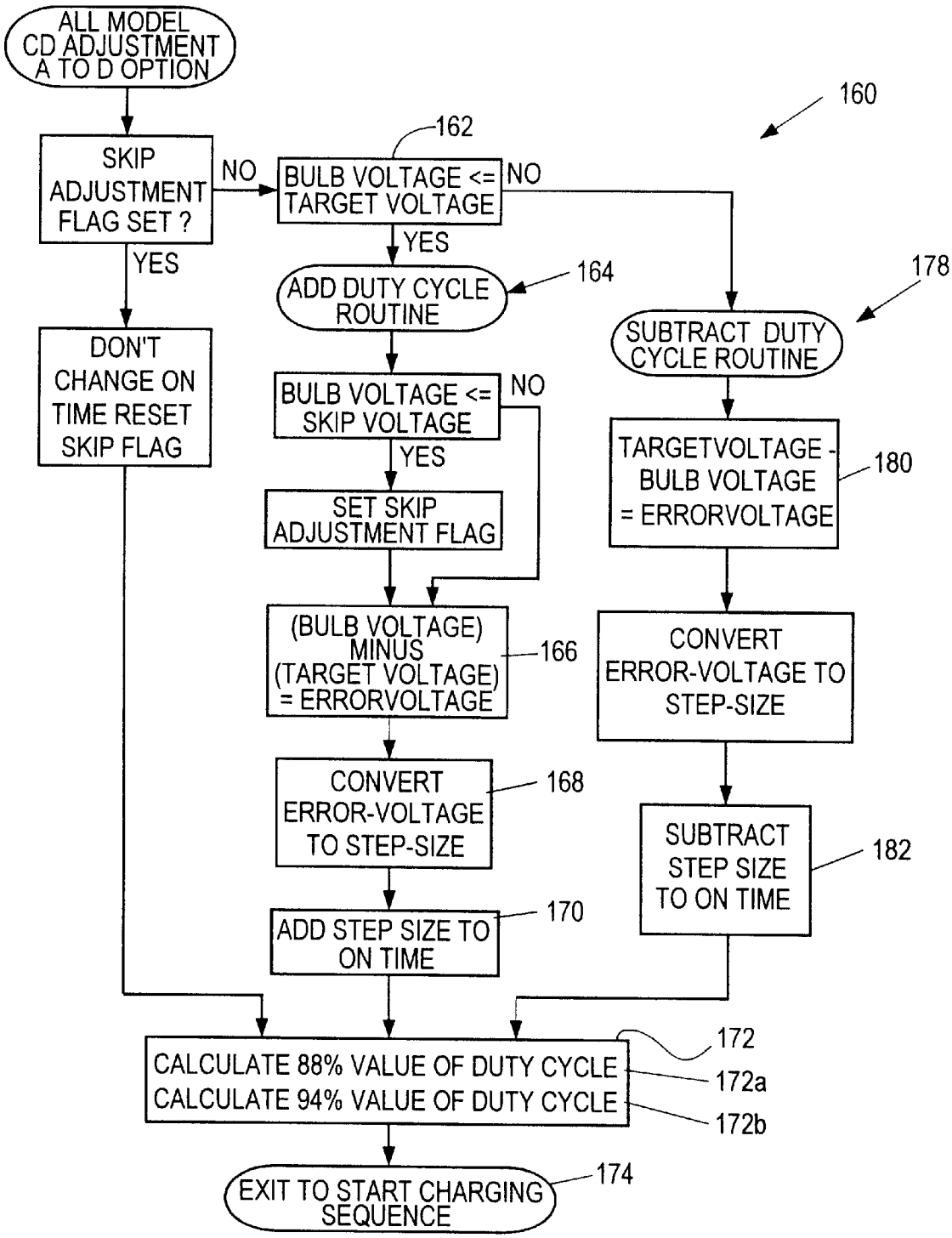

FIG. 4-1 illustrates steps 140 in adjusting the capacitor charging duty cycle parameter for respective settings of candela output where pulse width feedback circuitry 24-1, process 90, has been implemented. FIG. 4-2 illustrates steps in adjusting capacitor duty cycle for respective settings of candela output where analog-to-digital converter, process 92 has been implemented. It will be understood that model selection can also take place electronically, perhaps via a message received via power lines P in addition to or as an alternate to a locally settable switch or element.

In FIG. 4-1 in step 142 the contents of the timer buffer are compared to a maximum allowed time, such as 0.75 sec. If they exceed the threshold, in step 144 the duty cycle is increased by a maximum increment, for example 20 microseconds.

In step 146, substep 146*a* is a calculation to establish 88% of the current duty cycle. In step 146*b* 94% of the current duty cycle is determined. These two values are used in the next cycle, illustrated in FIG. 10, to ramp up the charging current from a minimal value, to a full 100% value. Step 148 is an exit to the flash routine. Other values could be used without departing from the spirit and scope of the present invention.

Steps 150*a* address a condition where the contents of the timer buffer exceed the target pulse width parameter for the respective candela value. Steps 150*b* address a condition where the contents of the timer buffer are less than the target pulse width parameter for that candela value.

Figures 1, 2, 3, 5:
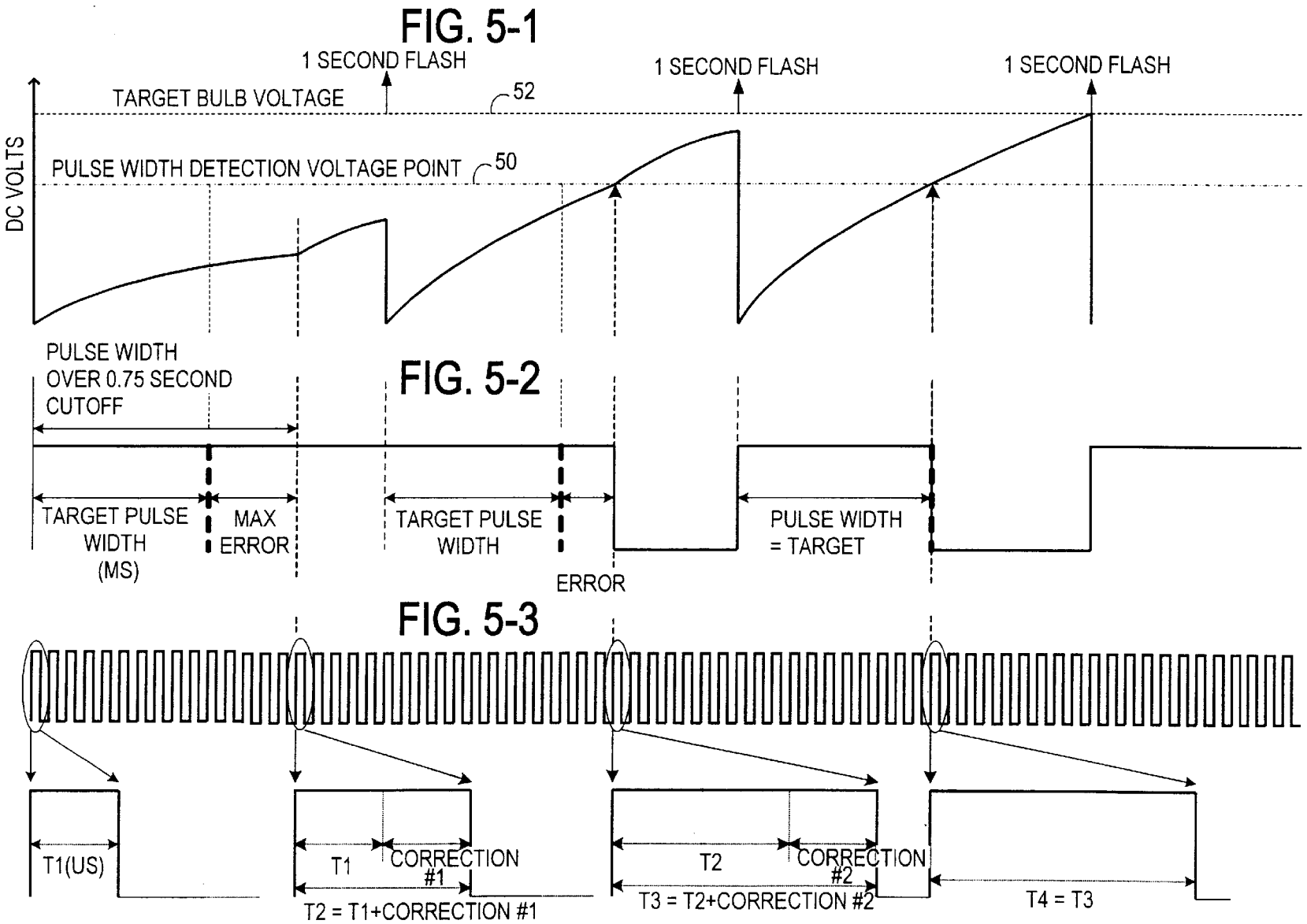

With respect to steps 150*a* and timing diagrams of FIGS. 5-1 to 5-3, in steps 150*a*-1,-2 the degree to which the pulse count exceeds the target pulse count is determined. As illustrated in FIG. 5-2, the duty cycle of the charging current should be increased to accelerate the increase of voltage on the capacitor. The duty cycle increase takes place immediately, see FIG. 5-3. The capacitor continues to charge and one second after the last trigger signal, the next trigger signal is issued by the processor 12, via circuitry 22 irrespective of the then capacitor voltage value, by the flash routine, step 148.

At the start of the next cycle, charging of the capacitor is initiated at 88% of the duty cycle, step 146*a* (see also FIG. 10). Subsequently after a selected time interval, as would be understood by those of skill in the art, the charging rate in increased to 94% of the duty cycle, step 146*b*. Then the charging rate is increased to 100% of the duty cycle, FIG. 5-3.

With a one second flash period, FIG. 5-1, the capacitor could be charged at the 88% and 94% levels for 15 milliseconds. Other time intervals could be used without departing from the spirit and scope of the present invention.

Once the capacitor has been discharged a surge of current may result when trying to recharge it. By starting each charge cycle, after a discharge, at a lower rate and increasing the current (by increasing the percent of the duty cycle) overcurrent or surge current problems can be minimized. This process minimizes power supply fold-back or shut down problems.

Figures 1, 2, 3, 6:
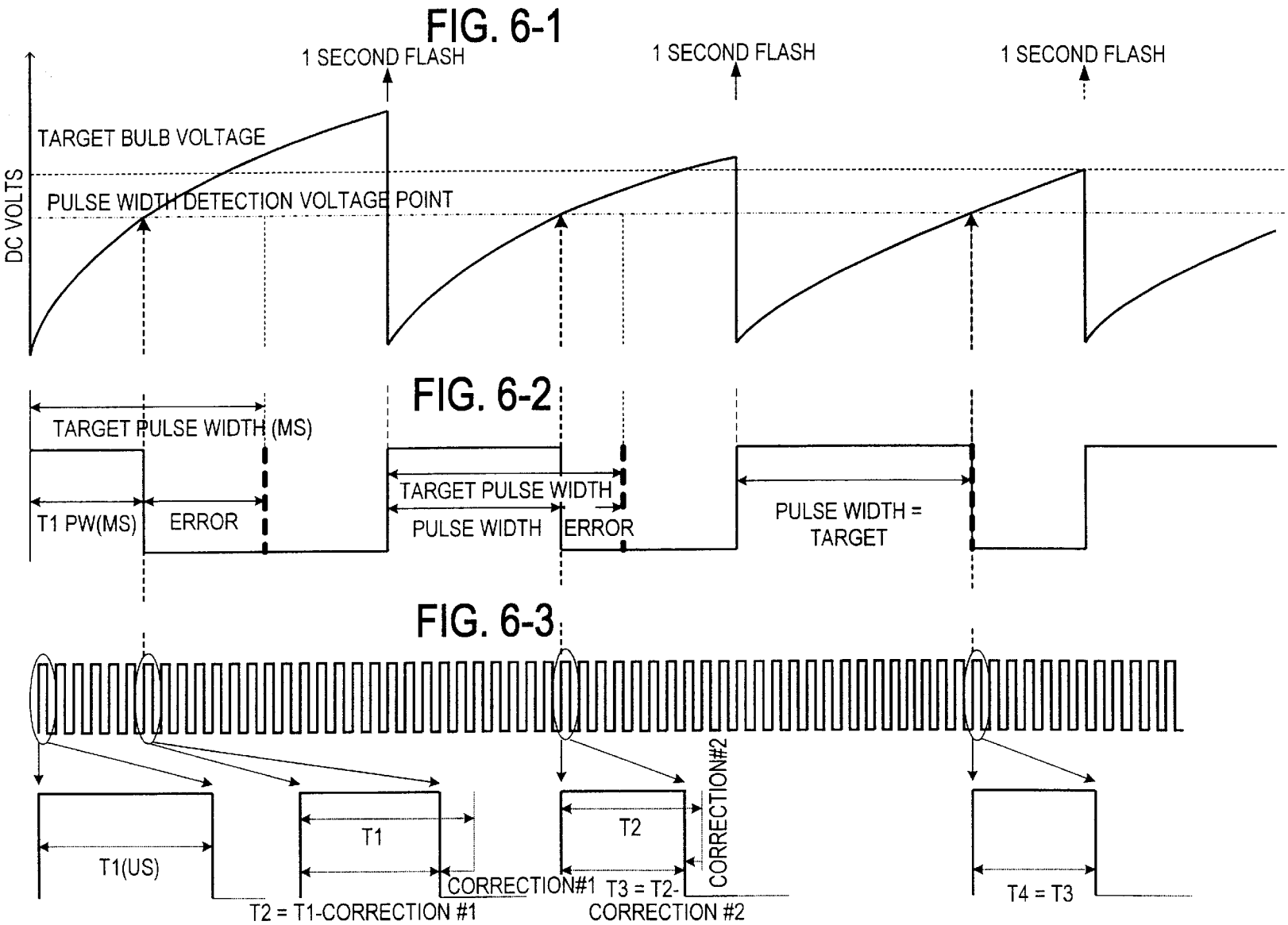

Steps 150*b*, and FIGS. 6-1 to 6-3, illustrate the operation of system 10 where the value of the target pulse width exceeds the contents of the pulse width timer. In this circumstance, the voltage across the capacitor has crossed the threshold before the 0.75 second interval. As illustrated in FIG. 6-1, the voltage across the capacitor has increased too quickly. Depending on the difference between the target pulse width and the measured pulse width, steps 150*b*-1, -2, the duty cycle will be decreased, FIG. 6-3.

Figure 9:
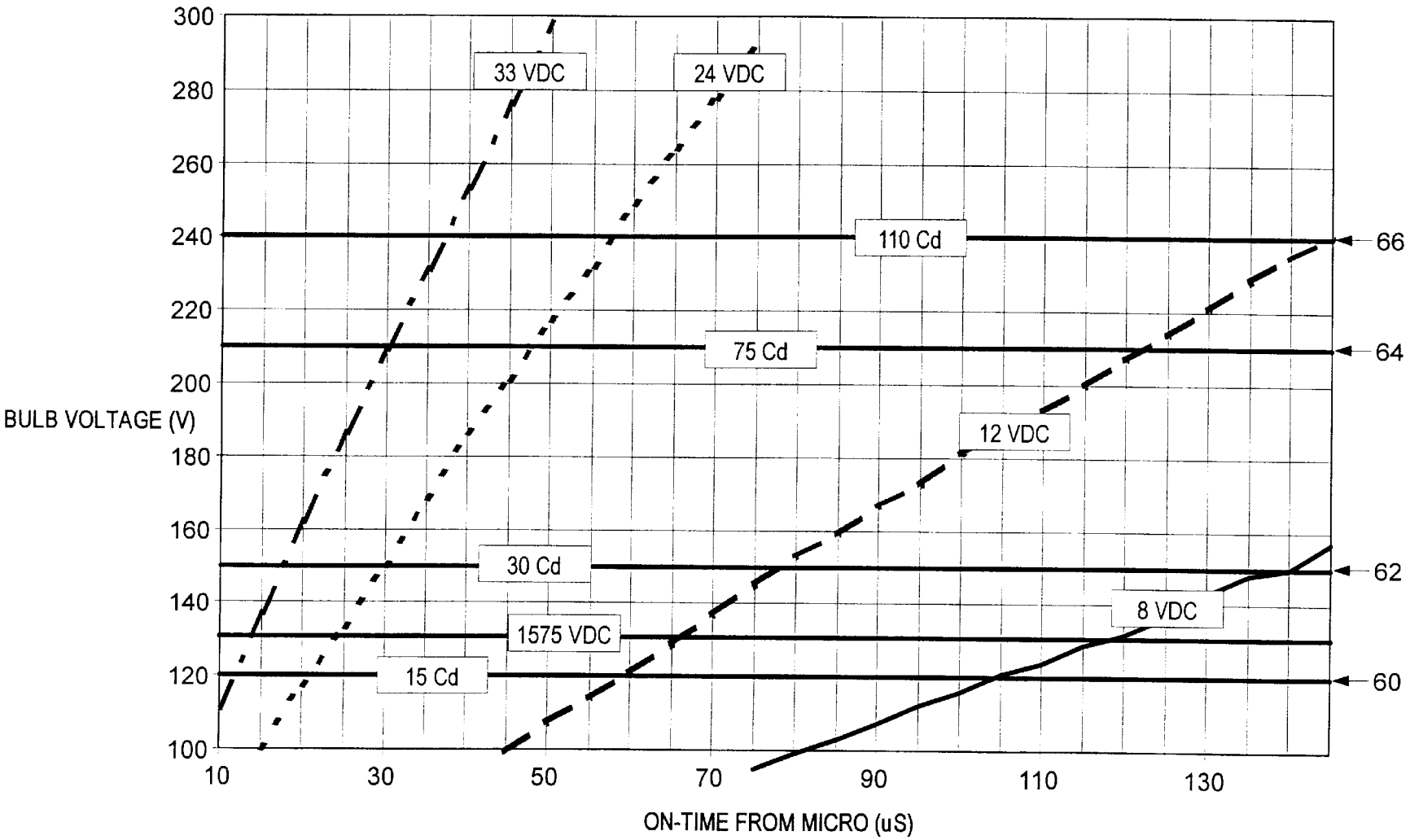
FIG. 9 is a series of graphs illustrating flash bulb voltage plotted against on-time for charging the bulb capacitor.

The above described process also automatically responds to variations in input voltage P. In FIG. 9, bulb trigger voltages have been plotted against on-time for charging the respective capacitor. Lines 60-66 indicate necessary voltage to flash the tube, circuitry 20, to produce the respective indicated candela output.

As illustrated in FIG. 9, duty cycle, on-time, is automatically adjusted to track input voltages ranging, for example, from 8–33 volts DC or 8–33 volts RMS, full wave rectified AC. The control process substantially maintains light output and flash tube trigger voltage at preselected values even in the presence of such variations.

As the applied voltage decreases, the on-time will be automatically be increased to provide increased current to charge the capacitor. Where the period of the charging current is, for example 160 microseconds, the 10–135 microsecond variation, plotted against the X axis, FIG. 9, illustrates the increase in duty cycle necessary to compensate for falling input voltage.

The steps of FIG. 4-2 in combination with FIGS. 7-1, -2 and 8-1, -2 illustrate steps 160 of the duty cycle adjustment process where an analog-to-digital converter is used in combination with divider circuitry 24-2, process 92. In a step 162, actual bulb voltage, digitized, is compared to a preselected, candela related, output voltage. If less than the target voltage, the steps of Add Duty Cycle routine 164 are executed, see FIGS. 7-1, -2.

At the end of each flash cycle, for example one second (see FIG. 10), in the add duty cycle routine, in step 166 the error voltage is determined by subtracting actual capacitor voltage from a pre-stored, candela specific, target voltage 60. In a step 168 a step size is determined by dividing the error voltage by a constant as would be understood by those of skill in the art. The resultant step size is added to the current "on-time" (T1 in FIG. 7-2) in a step 170 to form the "on time" for the next cycle, see FIG. 10.

In step 172 to ramp up to full duty cycle over a period of time, 88% of full duty cycle is determined in step 172 and 94% in step 172*b*. The process 160 terminates for the current cycle with an exit, step 174 to the flash routine.

As illustrated in FIG. 10, for both processes 90, 92, at the start of the next cycle, interval 154, circuits 16, 18 are deactivated. During interval 156-1 the circuits 16, 18 are energized for 87.5% of current duty cycle. This is increased to 93.75% of current duty cycle, interval 156-2. During interval 156-3, the capacitor is charged at 100% of the current duty cycle.

When carrying out process 90, the adjustment to the duty cycle is made during the current cycle, at the end 154-1 of the 100% charging duty cycle interval.

When carrying out process 72, the adjustment to duty cycle is made at the beginning of the next cycle, time interval 154.

Figures 1, 8:
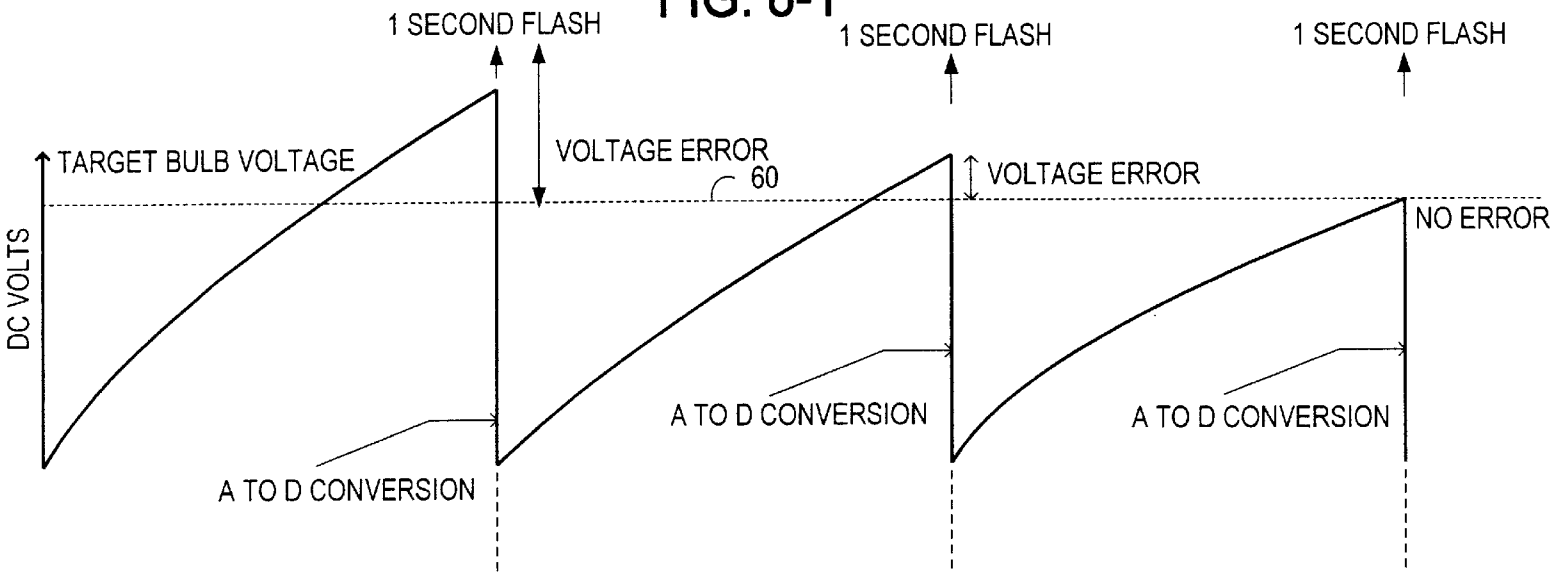
Figures 2, 8:
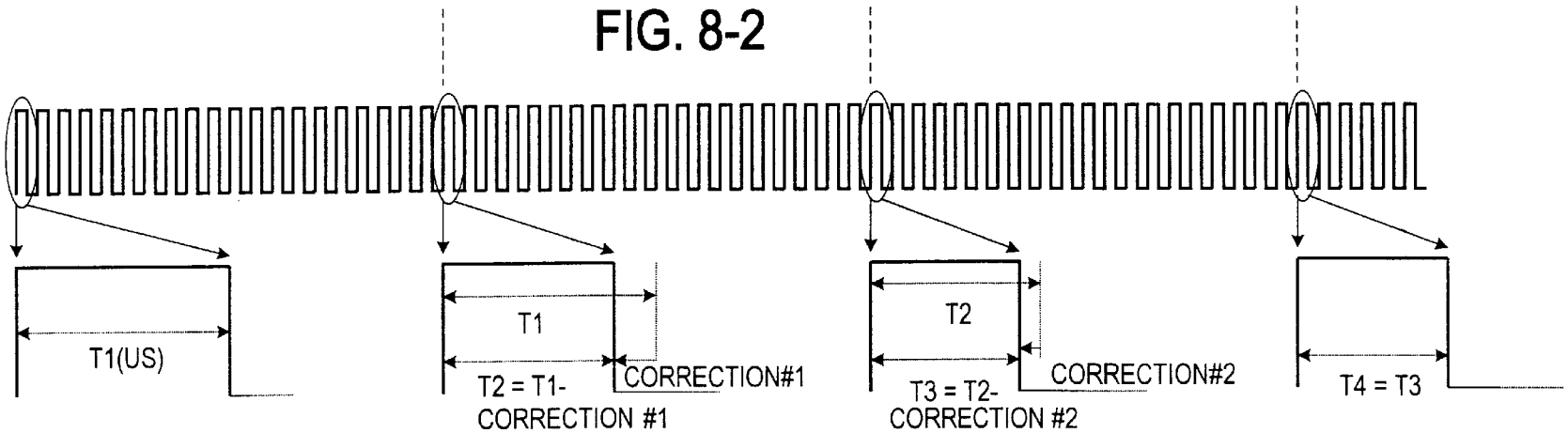

With respect to FIG. 4-2, where the bulb voltage exceeds the target voltage, FIGS. 8-1 and 8-2, the steps 178 of the Subtract Duty Cycle Routine are executed. An error voltage is determined in step 180. The error voltage is, in an exemplary embodiment, subtracted from the on time, reducing the duty cycle in a step 182 before making the step 172 calculations and exiting.

The above described process continues between flashes until the final target value is reached. The system 10 continues to dynamically adjust the duty cycle in order to keep the pulse width equal to the target value, or, to keep actual capacitor voltage equal to a candela dependent target value. It will be understood that previously discussed parameters for incrementing the duty cycle are exemplary only and could be varied without departing form the spirit and scope of the present invention.

It will also be understood that the control process of reaching and maintaining the target pulse width, or, alternately, reaching and maintaining the target voltage enables the system 10 to track varying input voltages in the lines P as illustrated in FIG. 9. At any time, if the capacitor voltage exceeds a preset value, charging will be temporarily halted and the flash tube flashed thereby discharging the capacitor.

Figure 11:
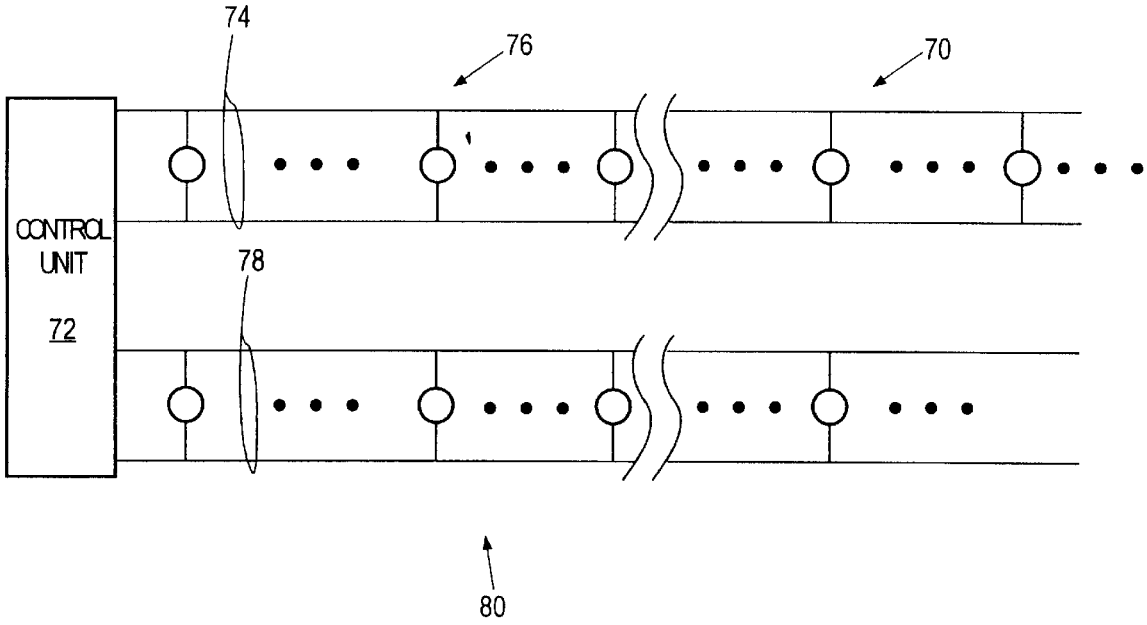
FIG. 11 is a block diagram of a system in accordance with the invention.

FIG. 11 illustrates a monitoring system 70 which includes a common control element 72, a bi-directional communications link 74 and a plurality of electrical units 76. The plurality 76 can include ambient condition detectors, such as fire detectors. Information pertaining to detected fires can be coupled to the control element 72 via link 74.

A second communications link 78, coupled to control element 72 is also coupled to the members of a plurality 80 of output devices, such as the apparatus 10. The link 78 can provide electrical energy to the members of the plurality 80 as well as synchronizing signals. The control element 72 can supply electrical energy to the link 78.

It will also be understood that units 80, such as the device 10 can also be coupled to the link 74. In this embodiment, the units 80 not only receive power from the link 74, they can receive messages from and send messages to members of the plurality 76. Even though they are coupled to link 74, if desired units 80 can continue to receive power from a separate source.

Strobe charging circuits usually draw higher current on power up and immediately following a flash because the storage capacitors in the strobe are large energy storage devices that tend to draw high surge currents whenever voltages are changing. Circuitry in power regulator 14 and switching control circuitry 16 in combination with prestored instructions executed by processor 12 minimize such in-rush currents. The strobe 10 incorporates two different types of in-rush current control circuits and processes.

Figures 18A, 18B, 18C:
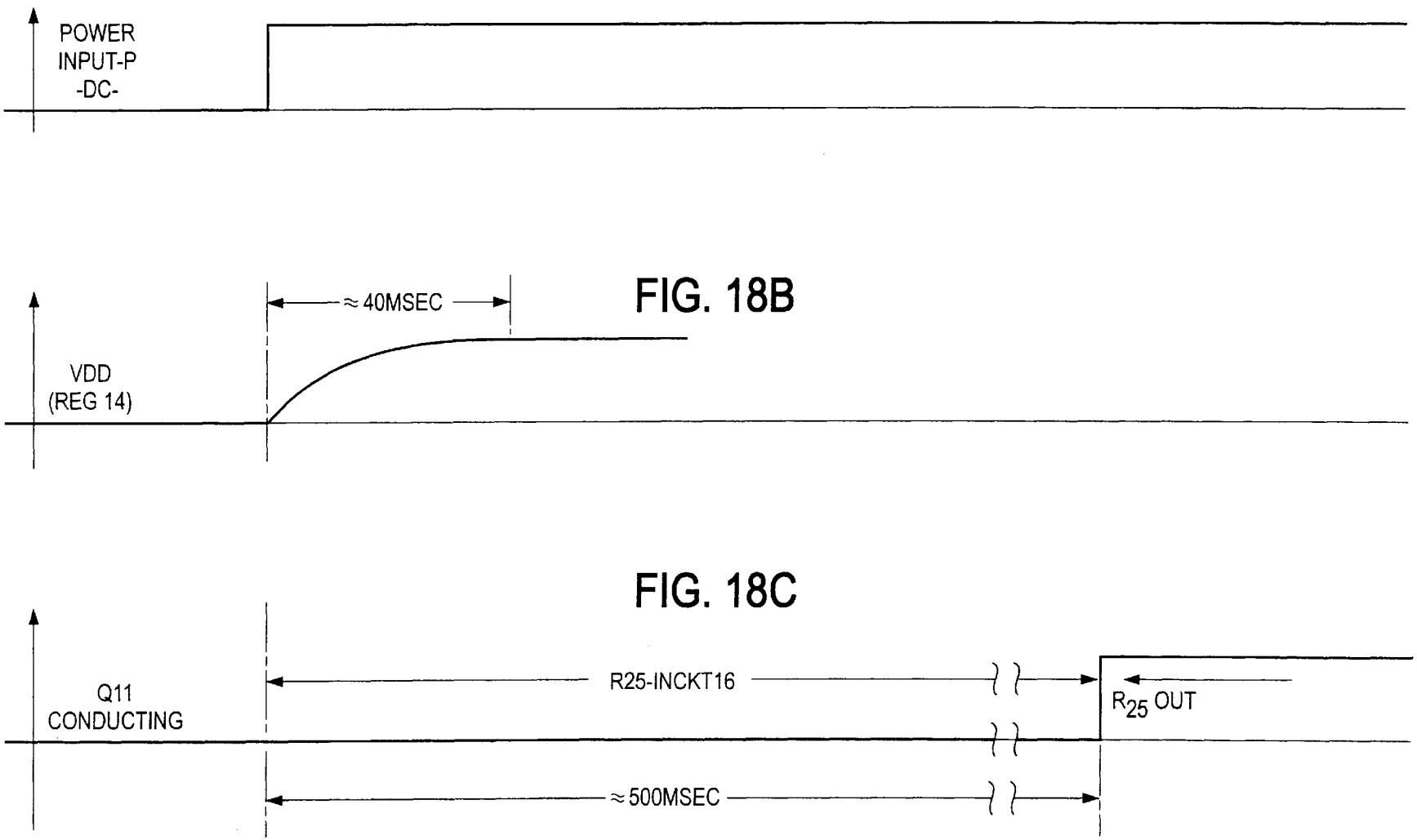
FIGS. 18A–C illustrate operation of the circuit of FIG. 17.

With respect to FIGS. 18A–C, when DC-type power is first applied, Power Input Lines, FIG. 1, the in-rush current to processor 12 is limited by smoothing capacitor C5, FIGS. 16-4, -5, -6, in regulator 14. Regulator output voltage VDD takes about 40 ms to achieve final output voltage, see FIG. 18B. In addition, during the first 500 ms, the power supplied to the strobe unit 20 is limited by a current limiting resistor R25 in control circuitry 16, see FIG. 17. As illustrated in FIG. 18C after the 500 ms, the resistor R25 is by-passed by FET Q11 and the current to strobe unit 20 is permitted to increase under the control of processor 12.

FET Q11 is switched to conduction by transistor Q12. Base drive to transistor Q12 can be provided by processor 12. Alternately, transistor Q12 can be switched to conduction by a voltage developed across a capacitor which is being charged, for example by VDD.

Figures 1, 2, 3, 4, 12:
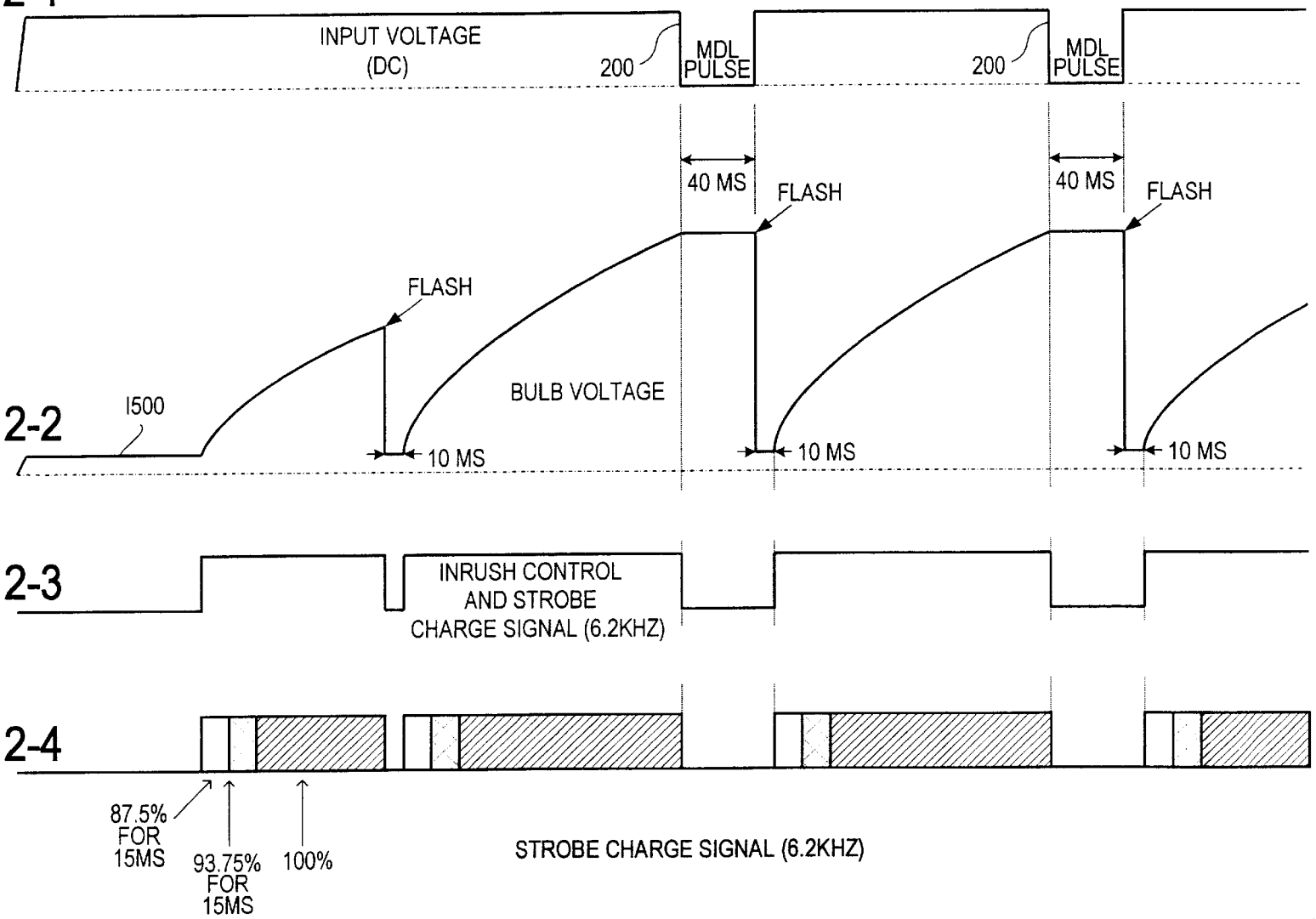
Figures 1, 2, 3, 4, 13:
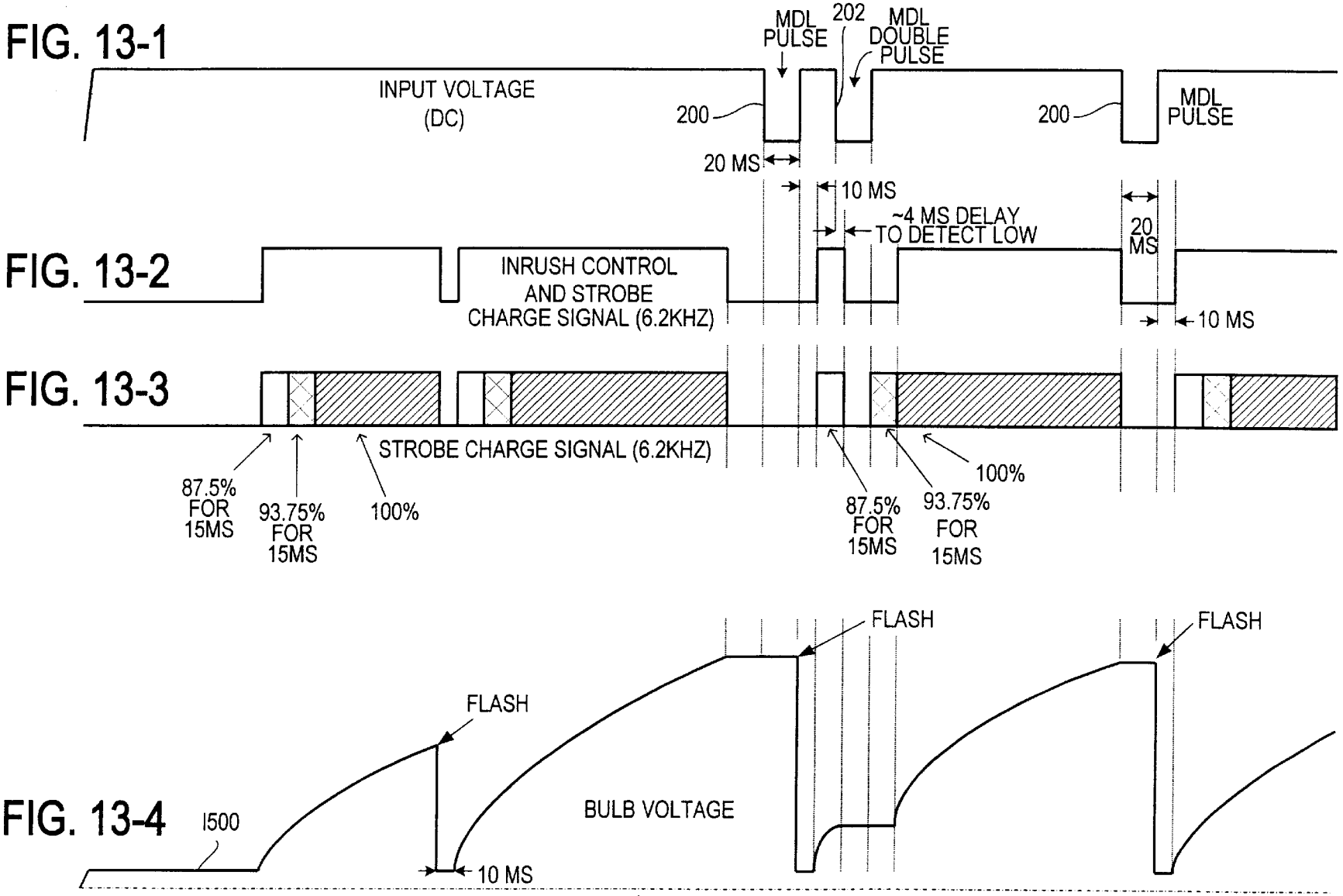
Figures 1, 14:
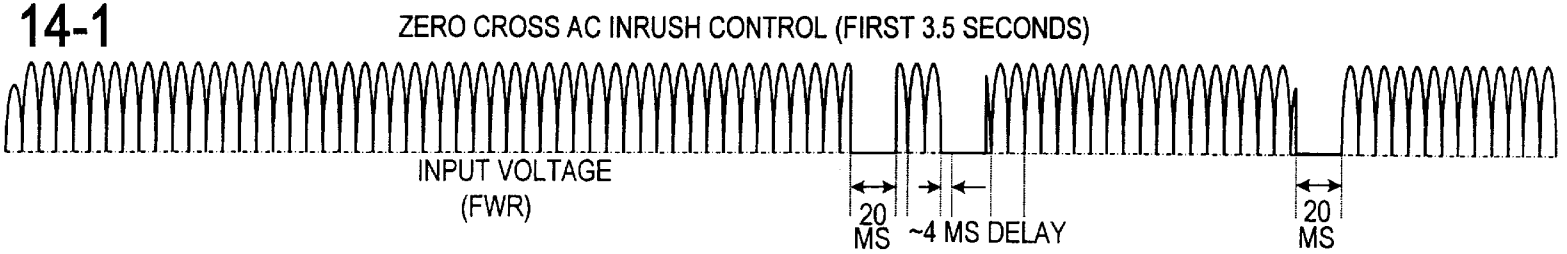
Figures 2, 14:
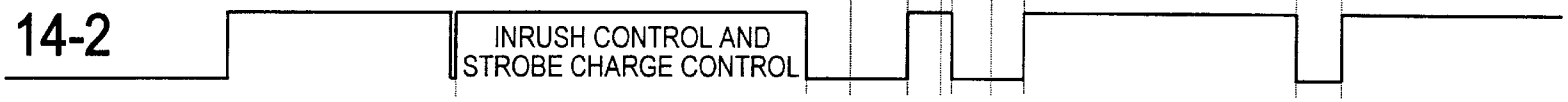
Figures 3, 14:
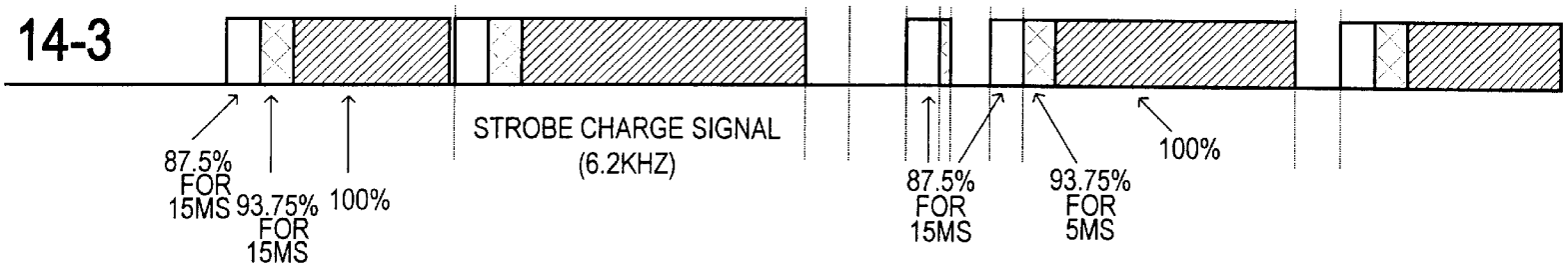
Figures 4, 14:
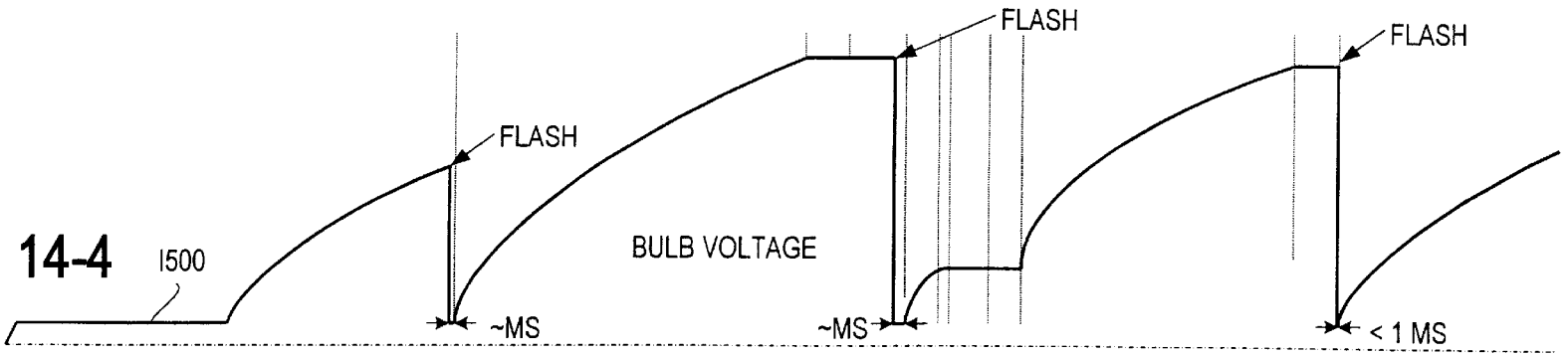

Processor 12 will increase the duty cycle of the charging current for strobe 20, see FIGS. 12-4 in 15 ms intervals up to 100% duty cycle. When the power input signal goes low, pulse 200, the charging circuit is turned off to block further discharge of the capacitors 20-1 until the start of the next charging cycle, see FIG. 12-3.

An up-going transition of pulse 200 causes the firing circuitry 22 to flash the tube 20-2. This then produces an optically synchronized visual output from the plurality of strobes coupled to lines 78, see FIG. 11.

FIGS. 13-1, -2, -3, -4 are a set of graphs illustrating details of capacitor charging in response to double control pulses 200, 202 in an applied DC signal. Pulses 200, on an up-going transition, trigger strobes coupled to lines 78 in synchronism. Pulses 202 provide added control functions. In between the double control pulses 200, 202 illustrated in FIG. 13-3, the charging circuit 28 is turned off to block further discharge of the strobe energy storage capacitor(s) 20-1 until the start of the next charging cycle.

Figures 1, 2, 3, 4, 15:
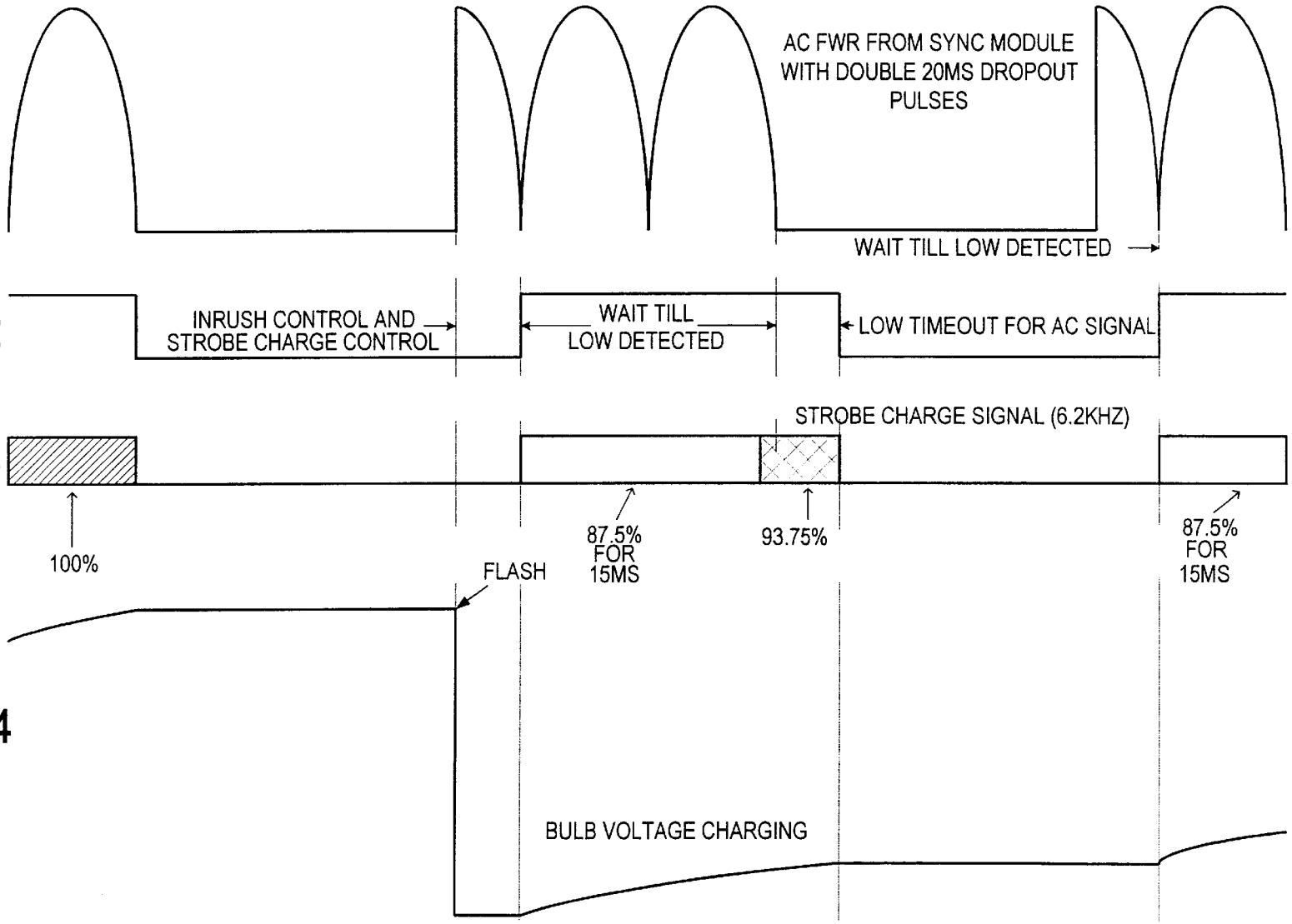
Figures 1, 16:
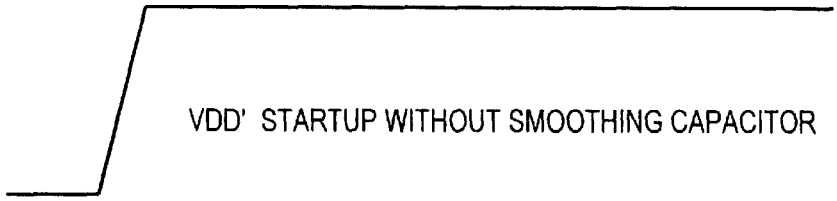
Figures 2, 16:
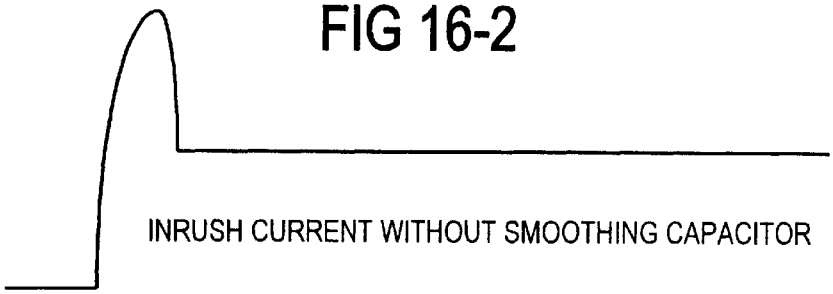
Figures 3, 16:
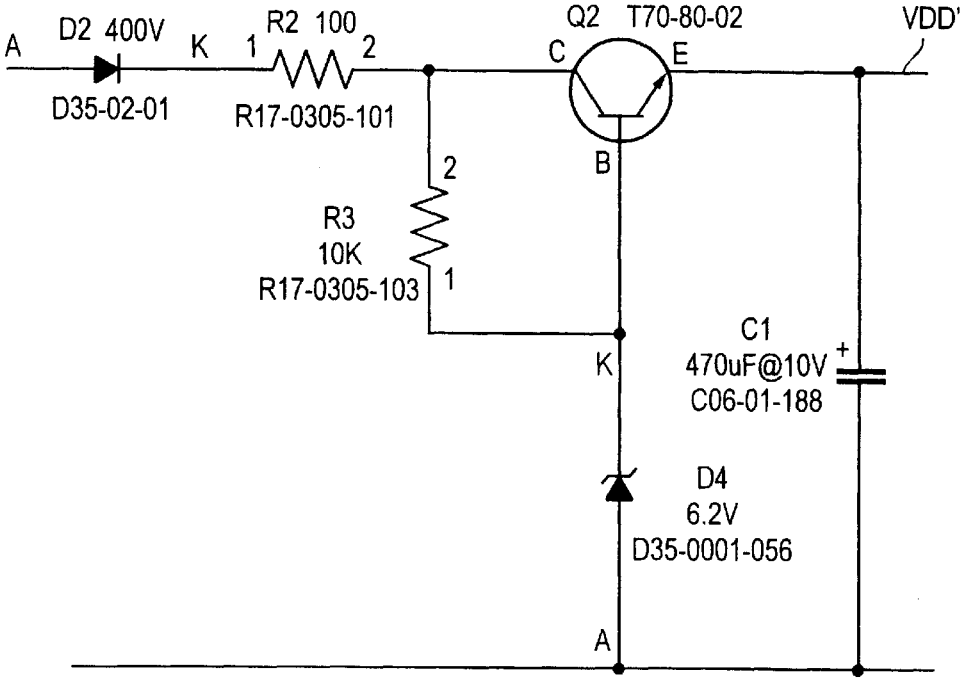
Figures 4, 16:
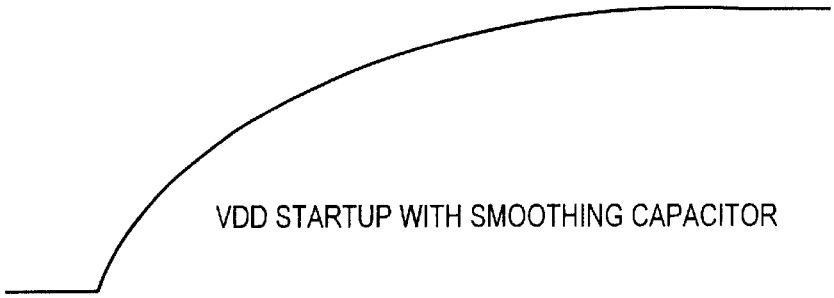
Figures 5, 16:
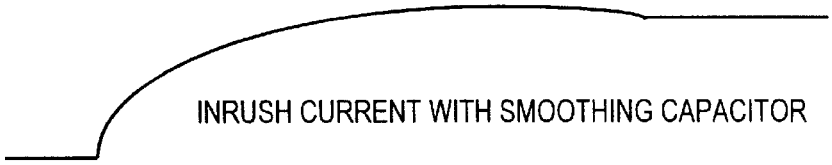
Figures 6, 16:
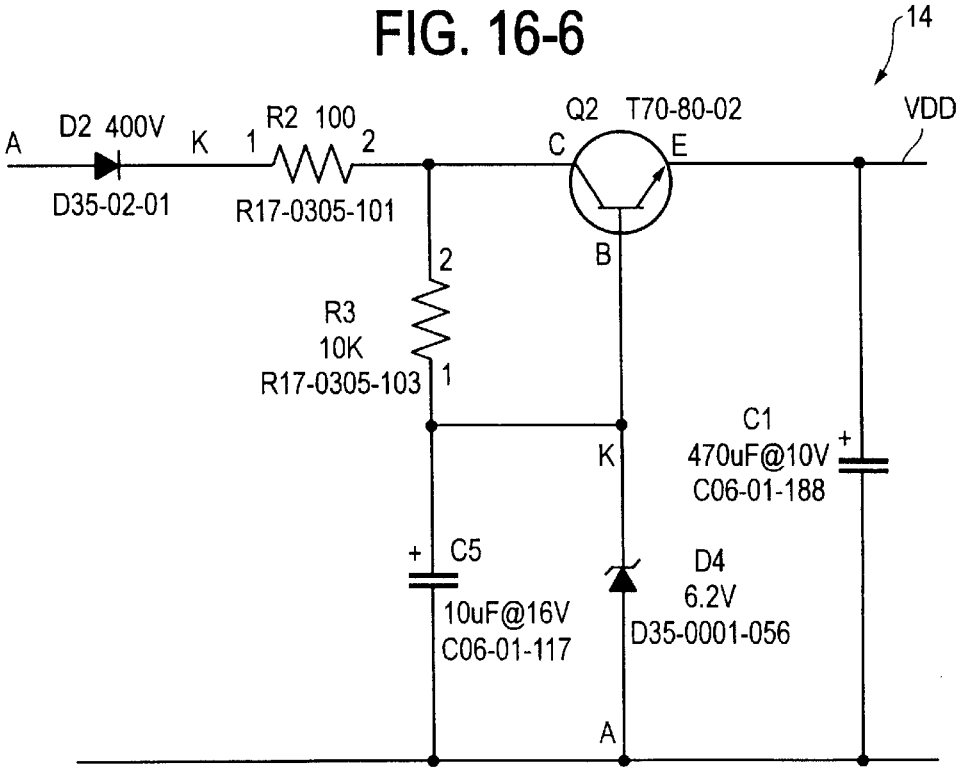
Figure 17:
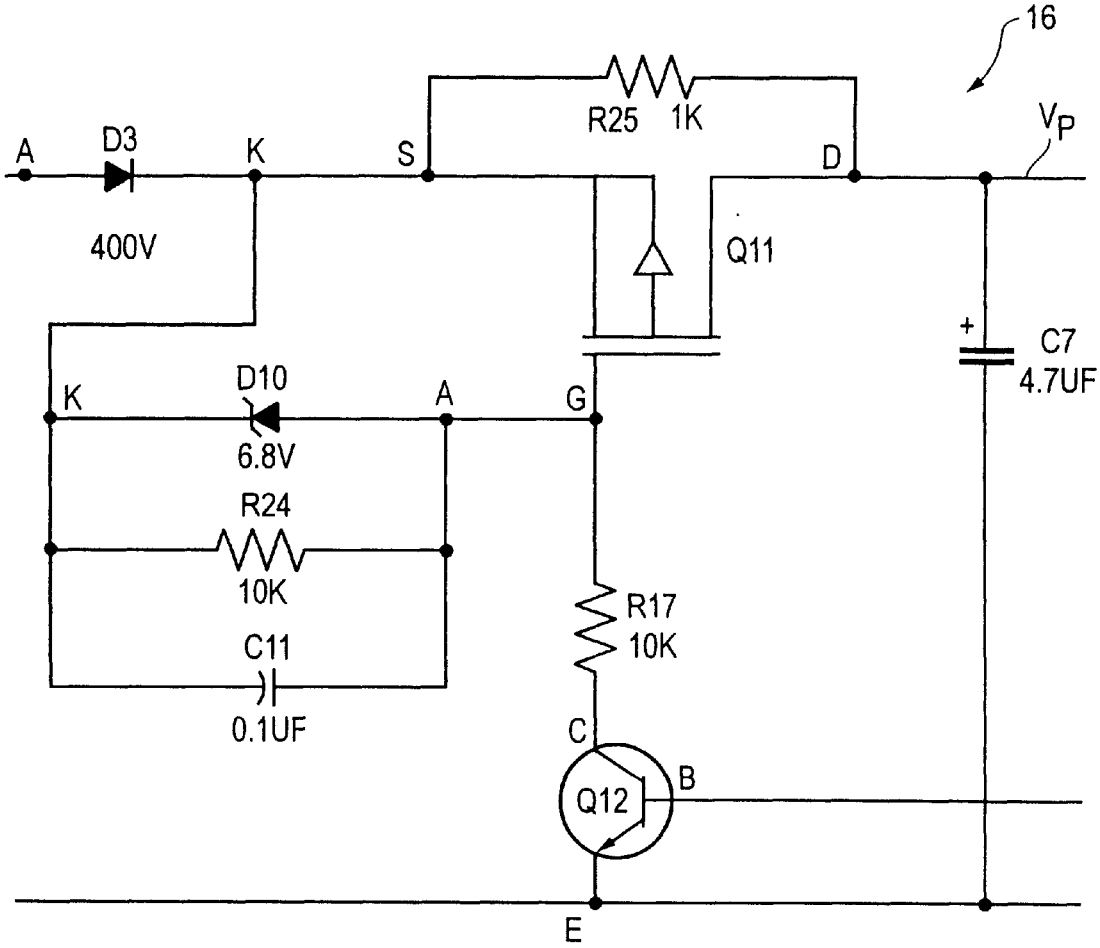
FIG. 17 is a schematic of power switching and control circuitry illustrating use of a turn-on current limiting resistor.

In FIGS. 14-1, -2, -3, -4, input voltage variations in applied, full wave rectified AC and times of initiation of charging current at a zero volt applied AC condition are illustrated. FIGS. 15-1 to 15-4 illustrate in-rush control for dual control pulses.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A strobe circuit comprising:

a flashable source of illumination;

a capacitor, coupled to the source, for providing energy for flashing the source;

a multi-state charging circuit, coupled to the capacitor, for charging same;

a control circuit, coupled to the charging circuit, wherein the control circuit switches the charging circuit through a plurality of states to minimize in-rush current, and wherein a duty cycle parameter is increased within a selected flash cycle;

a power supply wherein the power supply limits in-rush current to the control circuit, the control circuit adjusts a duty cycle parameter of the charging current; and wherein the duty cycle varies over several charging cycles in response to selected feedback.

2. A strobe circuit as in claim 1 wherein the charging circuit includes an impedance element, coupled to a switching circuit wherein the charging circuit in one phase provides charging current through the impedance and in another phase the impedance is by-passed providing a larger charging current.

3. A strobe circuit as in claim 1 wherein the source is flashed in response to an applied multi-state control signal and wherein charging is inhibited during at least one state of the applied control signal.

4. A strobe circuit as in claim 1 wherein the control circuit includes circuitry for minimizing discharge of the capacitor in response to a predetermined condition.

5. A strobe circuit as in claim 4 wherein the predetermined condition comprises a selected input voltage.

6. A strobe circuit as in claim 4 wherein the control circuitry includes circuitry responsive to information carrying variations in an applied power signal sensed by the circuitry to minimize discharge of the capacitor in response thereto.

7. A method of limiting charging in-rush current in an electrical unit that has an energy storage capacitor which is periodically charged and discharged, the method comprising:

turning off charging current for a period of time;

imposing a current limiting element and initiating a limited charging current of a first magnitude for a first time interval;

establishing a charging current duty cycle, less than 100%;

increasing the duty cycle in accordance with a preset schedule to charge the capacitor to a selected threshold; and discharging the capacitor and repeating the above steps during at least one subsequent charging cycle.

8. A method as in claim 7 which includes providing a periodic discharging signal during the discharging step.

9. A method as in claim 7 which includes varying the duty cycle in response to selected feedback signals.

10. A method as in claim 9 wherein the feedback signals are indicative of accumulated charge at the capacitor.

11. A method as in claim 10 which includes limiting a rate of increase of an internal voltage responsive to a switched, exterior applied voltage.

12. A strobe control circuit comprising:

circuitry for accommodating input voltages having on the order of 100% amplitude variation;

circuitry responsive to a selected candela output for altering a charging parameter; and circuitry for minimizing a current in-rush thereto.

13. A strobe circuit as in claim 12 wherein the responsive circuitry includes a circuit for charging a capacitor to a selected voltage despite variations in the input voltage.

14. A strobe circuit as in claim 13 wherein the responsive circuitry includes circuitry for monitoring a capacitor voltage while charging same.

15. A strobe circuit as in claim 14 wherein a charging rate can be altered in real-time during respective charging cycles.

16. A strobe circuit as in claim 14 which includes capacitor charging circuitry with a variable capacitor charging rate.

17. A strobe circuit as in claim 16 which includes circuitry for varying the charging rate responsive to the time required to achieve a selected capacitor voltage.

18. A strobe circuit as in claim 12 which includes a programmed processor having pre-stored indicia associated with a plurality of candela outputs.

19. A strobe circuit as in claim 18 which includes an output candela specifier.

20. A strobe circuit as in claim 19 wherein the candela specifier comprises at least one of a manually settable element, and an electrically settable element.

21. A strobe circuit comprising:

a flashable source of illumination;

a capacitor, coupled to the source, for providing energy for flashing the source;

a charging circuit, coupled to the capacitor, for charging same;

a control circuit, coupled to the charging circuit, wherein the control circuit adjusts a duty cycle parameter of the charging current such that the duty cycle varies over several charging cycles in response to selected feedback.

* * * * *